US008360742B2

(12) United States Patent
Kimoto et al.

(10) Patent No.: US 8,360,742 B2
(45) Date of Patent: Jan. 29, 2013

(54) SWASH PLATE COMPRESSOR

(75) Inventors: Yoshio Kimoto, Kariya (JP); Masaki Ota, Kariya (JP); Nobuaki Hoshino, Kariya (JP); Masahiro Kawaguchi, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 675 days.

(21) Appl. No.: 12/362,121

(22) Filed: Jan. 29, 2009

(65) Prior Publication Data

US 2009/0220354 A1 Sep. 3, 2009

(30) Foreign Application Priority Data

Feb. 5, 2008 (JP) ..... 2008-025757
Feb. 20, 2008 (JP) ..... 2008-038686

(51) Int. Cl.
*F04B 1/26* (2006.01)

(52) U.S. Cl. ..... 417/222.2; 92/154; 92/156

(58) Field of Classification Search ..... 417/222.2, 417/269, 272, 228; 92/154, 156, 153, 12.2; 137/53, 56

See application file for complete search history.

(56) References Cited

U.S. PATENT DOCUMENTS 3,590,838 A * 7/1971 Brady ..... 137/56
3,799,183 A * 3/1974 Shoichi ..... 137/56
4,685,866 A 8/1987 Takenaka et al.
4,872,814 A 10/1989 Skinner et al.
4,884,952 A * 12/1989 Kanamaru et al. ..... 417/222.2
5,063,829 A * 11/1991 Takao et al. ..... 92/71
5,224,848 A * 7/1993 Noburu et al. ..... 418/55.1
5,683,236 A * 11/1997 Harrison et al. ..... 418/55.1
5,836,748 A * 11/1998 Kawaguchi et al. ..... 417/222.2
5,971,716 A * 10/1999 Ota et al. ..... 417/222.2
6,102,669 A * 8/2000 Fujita ..... 417/222.2
6,102,670 A * 8/2000 Taguchi ..... 417/222.2
6,164,926 A * 12/2000 Kawaguchi ..... 417/222.2

(Continued)

FOREIGN PATENT DOCUMENTS

EP 1207301 A2 5/2002
EP 1310675 A2 5/2003

(Continued)

OTHER PUBLICATIONS

European Search Report issued on Jun. 10, 2009, for European Patent Application No. 09151432.3.

(Continued)

*Primary Examiner* — Devon Kramer
*Assistant Examiner* — Christopher Maxey
(74) *Attorney, Agent, or Firm* — Locke Lord LLP

(57) ABSTRACT

A swash plate compressor capable of realizing an excellent sliding characteristic when a drive shaft is rotated at high speed, and a high refrigerating capacity when the drive shaft is rotated at low speed, has a release passage for communication between a crank chamber and a suction chamber. The release passage includes a first passage communicated to an oil rich region, in the crank chamber, and a second passage communicated to an oil poor region, in which lubricating oil is small in quantity, in the crank chamber. A valve mechanism that increases an opening ratio of the first passage with respect to the release passage, as a rotational speed of a drive shaft increases, and increases an opening ratio of the second passage with respect to the release passage, as the rotational speed of the drive shaft decreases.

20 Claims, 21 Drawing Sheets

U.S. PATENT DOCUMENTS

| | | | | |
|---|---|---|---|---|
| 6,202,301 | B1 * | 3/2001 | Kawaguchi | 29/888.02 |
| 6,267,562 | B1 * | 7/2001 | Hirota | 417/222.2 |
| 6,474,955 | B1 * | 11/2002 | Ota et al. | 417/222.2 |
| 6,517,321 | B1 * | 2/2003 | Takenaka et al. | 417/222.1 |
| 6,544,004 | B2 * | 4/2003 | Fujii et al. | 417/222.2 |
| 6,769,667 | B2 * | 8/2004 | Kume et al. | 251/129.18 |
| 6,939,112 | B2 * | 9/2005 | Taguchi | 417/222.2 |
| 6,942,465 | B2 * | 9/2005 | Kawachi et al. | 417/269 |
| 7,140,343 | B2 * | 11/2006 | Sanderson | 123/197.1 |
| 7,204,098 | B2 * | 4/2007 | Yamada et al. | 62/470 |
| 7,334,548 | B2 * | 2/2008 | Sanderson et al. | 123/56.1 |
| 7,530,797 | B2 * | 5/2009 | Ito et al. | 417/222.2 |
| 7,857,601 | B2 * | 12/2010 | Taguchi | 417/222.2 |
| 8,038,415 | B2 * | 10/2011 | Park et al. | 417/222.2 |
| 2002/0104327 | A1 | 8/2002 | Murase et al. | |
| 2002/0172602 | A1 | 11/2002 | Fukanuma et al. | |
| 2003/0089123 | A1 | 5/2003 | Tarutani et al. | |
| 2004/0253118 | A1 * | 12/2004 | Inoue et al. | 417/222.1 |
| 2004/0258536 | A1 * | 12/2004 | Ota et al. | 417/222.2 |
| 2004/0265144 | A1 * | 12/2004 | Fukanuma et al. | 417/374 |
| 2005/0124446 | A1 * | 6/2005 | Iwasa et al. | 474/69 |
| 2005/0169769 | A1 * | 8/2005 | Kanai | 417/269 |
| 2006/0008359 | A1 | 1/2006 | Ito et al. | |
| 2007/0014674 | A1 * | 1/2007 | Fukanuma et al. | 417/222.2 |
| 2007/0081905 | A1 * | 4/2007 | Takahashi et al. | 417/269 |
| 2007/0292279 | A1 * | 12/2007 | Wakita et al. | 417/269 |
| 2008/0240928 | A1 * | 10/2008 | Wang et al. | 417/26 |
| 2008/0317584 | A1 * | 12/2008 | Murase et al. | 415/112 |
| 2009/0022604 | A1 * | 1/2009 | Hoshino et al. | 417/269 |
| 2009/0129948 | A1 * | 5/2009 | Hoshino et al. | 417/269 |
| 2009/0142210 | A1 * | 6/2009 | Hoshino et al. | 417/559 |
| 2009/0220355 | A1 * | 9/2009 | Ogi et al. | 417/222.1 |
| 2009/0220356 | A1 * | 9/2009 | Yamamoto et al. | 417/222.1 |
| 2009/0223244 | A1 * | 9/2009 | Kimoto et al. | 62/470 |
| 2010/0269686 | A1 * | 10/2010 | Lee et al. | 91/505 |
| 2011/0164994 | A1 * | 7/2011 | Schwarzkopf | 417/269 |

FOREIGN PATENT DOCUMENTS

| | | | |
|---|---|---|---|
| EP | 1614896 | A1 | 1/2006 |
| JP | 03-081589 | A | 4/1991 |
| JP | 04-325781 | A | 11/1992 |
| JP | 06-288348 | A | 10/1994 |
| JP | 09-256958 | A | 9/1997 |
| JP | 10-054350 | A | 2/1998 |
| JP | 11-062824 | A | 3/1999 |
| JP | 2001-123946 | A | 5/2001 |
| JP | 2002-225549 | A | 8/2002 |
| JP | 2006-022785 | A | 1/2006 |

OTHER PUBLICATIONS

Office Action for corresponding Korean Application No. 10-2009-0009023, dated Jan. 20, 2011.

* cited by examiner

SWASH PLATE COMPRESSOR

CROSS-REFERENCE TO RELATED APPLICATION

This application claims the benefit of priority to Japanese Patent Application No. 2008-25757, filed on Feb. 5, 2008, and No. 2008-38686, filed on Feb. 20, 2008, the contents of which are hereby incorporated herein by reference.

BACKGROUND OF THE INVENTION

The present invention relates to a swash plate compressor.

JP-A-10-54350 discloses a conventional swash plate compressor. The swash plate compressor includes a housing composed of a front housing, a cylinder block and a rear housing, and the housing defines a plurality of cylinder bores, a suction chamber, a discharge chamber and a crank chamber therein. The front housing rotatably supports in the crank chamber a drive shaft, one end of which is exposed from the front housing. In the crank chamber, a swash plate is supported by the drive shaft so as to vary its inclination angle. Pistons are reciprocatingly received in the respective cylinder bores. Pairs of front and rear shoes are provided between the swash plate and the respective pistons for converting wobbling of the swash plate into reciprocation of the respective pistons. A supply passage provides communication between the discharge chamber and the crank chamber, and a capacity control valve is provided on the supply passage to regulate pressure in the crank chamber.

Also, with the swash plate compressor, the drive shaft is formed with a release passage, which communicates the crank chamber to the suction chamber. The release passage includes a first radial hole extending radially and an outflow hole extending axially and communicating the first radial hole to the suction chamber.

Further, with the swash plate compressor, a valve mechanism is provided on the drive shaft. The valve mechanism decreases opening degree of the release passage as the drive shaft is increased in rotating speed, and increases opening degree of the release passage as the drive shaft is decreased in rotating speed.

The swash plate compressor together with a condenser, an expansion valve, and an evaporator constitutes a refrigerating circuit, and the refrigerating circuit is used in air-conditioning apparatus for a vehicle. With the swash plate compressor, the capacity control valve adjusts pressure in the crank chamber on the basis of pressure in the suction chamber or a flow rate of refrigerating gas to change an angle of the swash plate with respect to the drive shaft to thereby change a discharge capacity of the compressor.

Also, with the swash plate compressor, while a vehicle is running at high speed, the release passage is decreased in opening degree as the drive shaft is increased in rotating speed, so that, in particular, when the compressor is put in a state of rotating at high speed with a large discharge capacity, reduction in compression load can be achieved by gradually increasing pressure in the crank chamber to decrease the discharge capacity. Conversely, with the swash plate compressor, while a vehicle is running at low speed, the release passage is increased in opening degree as the drive shaft is decreased in rotating speed, so that a desired refrigerating capacity can be achieved by gradually decreasing pressure in the crank chamber to increase the discharge capacity.

With a swash plate compressor, when a drive shaft is rotated at high speed, an improvement in sliding characteristic is required in sliding portions such as between cylinder bores and pistons, between a swash plate and respective shoes, and so on. Also, when a drive shaft is rotated at low speed, lubricating oil discharged with refrigerating gas to an external refrigerating circuit outside a swash plate compressor is demanded of reduction in quantity for achieving a high refrigerating capacity.

SUMMARY OF THE INVENTION

An object of the invention is to provide a swash plate compressor capable of realizing an excellent sliding characteristic when a drive shaft is rotated at high speed, and a high refrigerating capacity when the drive shaft is rotated at low speed.

Refrigerating gas mixed with lubricating oil is adopted in a swash plate compressor. According to experiments conducted by the inventors of the present invention, there are present an oil rich region, in which the lubricating oil contained in the refrigerating gas is large in quantity, and an oil poor region, in which the lubricating oil contained in the refrigerating gas is small in quantity, in a crank chamber of a swash plate compressor. For example, the oil rich region is present in an outer peripheral region of the crank chamber, and the oil poor region is present in an inner peripheral region of the crank chamber, that is, a region away from a wall surface of the crank chamber. This is because a swash plate rotates together with a drive shaft in the crank chamber and the lubricating oil is forced toward the outer peripheral region of the crank chamber by centrifugal force. Also, the lubricating oil is present in abundance in a region within the crank chamber adjacent to a cylinder bore.

The invention provides a swash plate compressor comprising a housing including a cylinder bore, a suction chamber, a discharge chamber and a crank chamber, a drive shaft supported by the housing to rotate in the crank chamber, a swash plate supported on the drive shaft and disposed in the crank chamber, a piston accommodated in the cylinder bore to reciprocate, a motion conversion mechanism provided between the swash plate and the piston to convert wobbling of the swash plate into reciprocation of the piston, and a release passage for communication between the crank chamber and the suction chamber, the compressor being characterized in that the release passage includes a first passage communicated to an oil rich region, in which lubricating oil is large in quantity, in the crank chamber, and in that a valve mechanism is provided to increase an opening ratio of the first passage with respect to the release passage, as the rotational speed of the drive shaft increases.

With the swash plate compressor according to the invention, when the drive shaft is rotated at high speed, the valve mechanism increases an opening ratio of the first passage with respect to the whole release passage. Therefore, refrigerating gas containing a large quantity of the lubricating oil in the crank chamber tends to move toward the suction chamber through the first passage. Therefore, the lubricating oil in the crank chamber becomes moderate in quantity, thus the swash plate does not agitate the lubricating oil so much, so that generation of heat due to shearing the lubricating oil is reduced and decrease in viscosity of the oil is prevented. Therefore, sliding portions are favorably lubricated. Also, refrigerating gas returning from the external circuit contains a large quantity of the lubricating oil, and sliding portions between the cylinder bore and the piston are favorably lubricated. In addition, while the lubricating oil contained in refrigerating gas discharged to the external circuit is increased in quantity at this time, no problem is caused in refrigerating capacity since the piston reciprocates at high speed.

Also, with the swash plate compressor, when the drive shaft is rotated at low speed, the valve mechanism decreases an opening ratio of the first passage with respect to the whole release passage. Therefore, refrigerating gas containing a large quantity of the lubricating oil in the crank chamber tends not to move to the suction chamber through the first passage. Therefore, the lubricating oil contained in refrigerating gas discharged to the external refrigerating circuit is decreased in quantity, a high refrigerating capacity is achieved. In addition, while a large amount of the lubricating oil is remained in the crank chamber at this time, the swash plate agitates the lubricating oil at low speed, so that the lubricating oil is not decreased so much in viscosity and the lubricating oil is little raised in temperature. Therefore, sliding portions are still lubricated favorably.

Accordingly, the swash plate compressor according to the invention may realize an excellent sliding characteristic when the drive shaft is rotated at high speed, and a high refrigerating capacity when the drive shaft is rotated at low speed.

Other aspects and advantages of the invention will be apparent from embodiments disclosed in the attached drawings, illustrations exemplified therein, and the concept of the invention.

BRIEF DESCRIPTION OF THE DRAWINGS

The invention will be described in more detail along with the concept and advantages thereof by referring to the attached drawings and the detailed description of the preferred embodiments below.

DETAILED DESCRIPTION OF THE PREFERRED EMBODIMENTS

EMBODIMENTS 1 to 5, in which the invention is embodied, will be described below with reference to the drawings.

Embodiment 1

Figure 1:
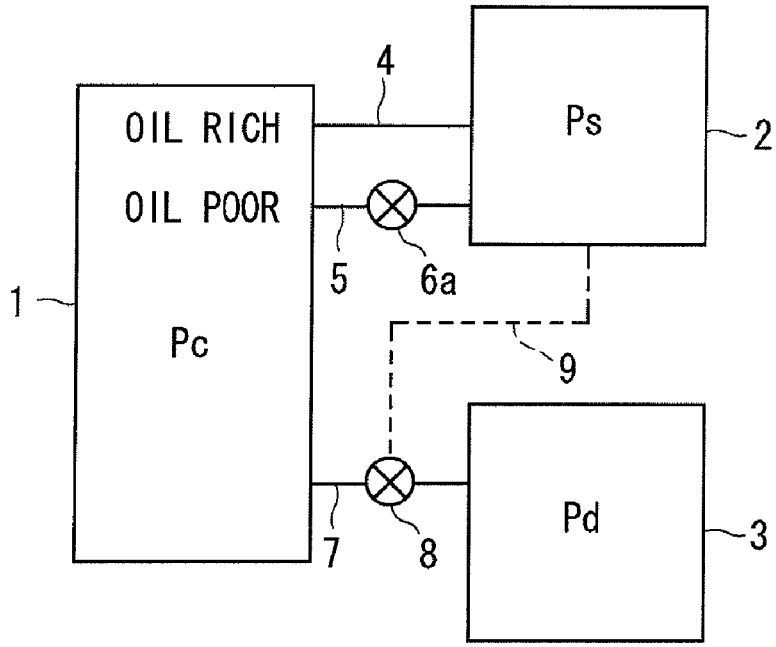
FIG. 1 is a schematic view showing an embodiment of the invention.

A swash plate compressor according to EMBODIMENT 1 is of a variable displacement type used for air-conditioning of a vehicle and embodies a feature shown in FIG. 1.

Figure 4:
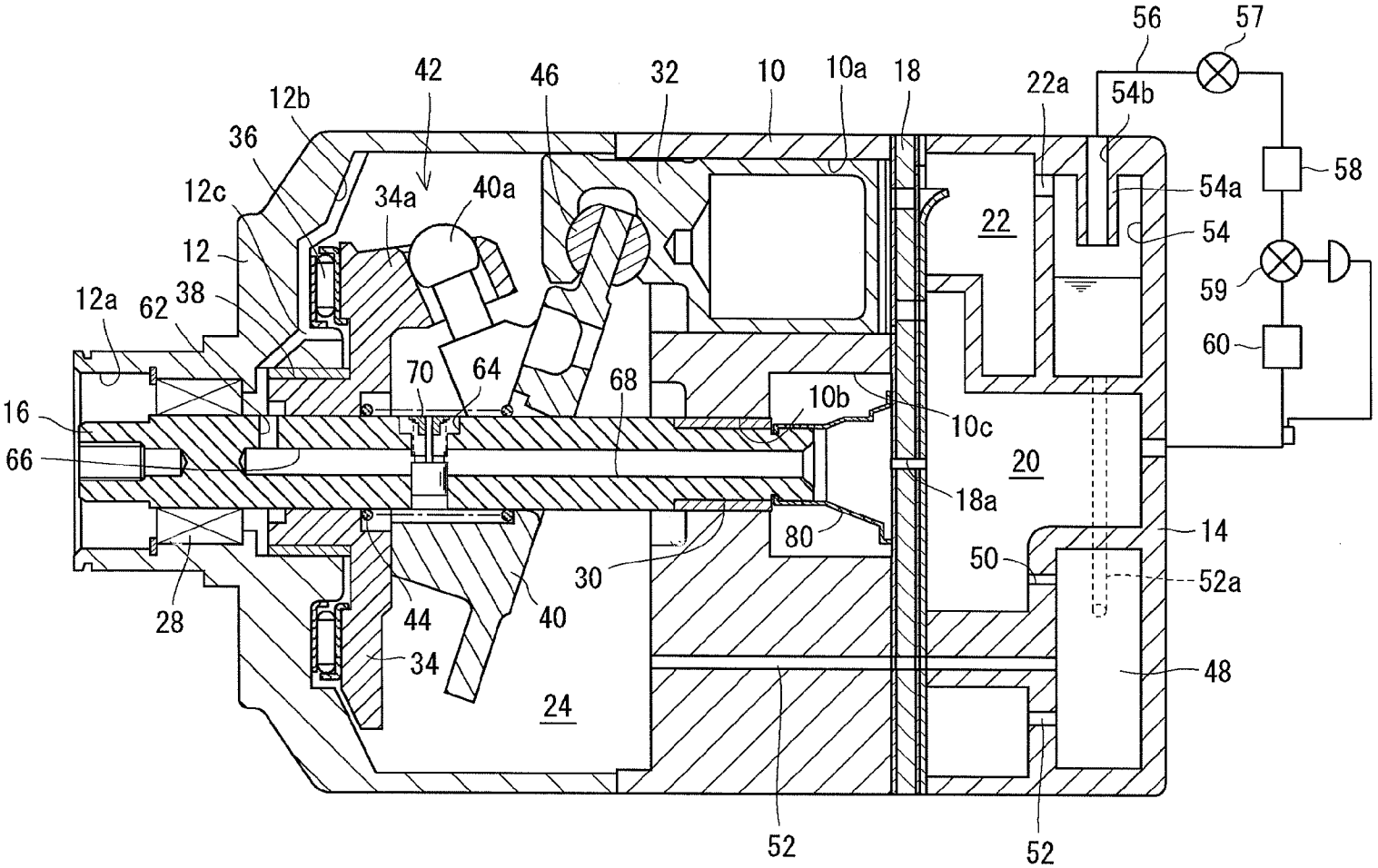
FIG. 4 is a cross sectional view showing a swash plate compressor according to EMBODIMENT 1.

As shown in FIG. 4, the compressor includes a housing composed of a cylinder block 10, a front housing 12, and a rear housing 14, and a plurality of cylinder bores 10*a* extending in parallel to an axis of a drive shaft 16 are provided on the cylinder block 10 to extend therethrough. In addition, the left in FIG. 4 indicates the front of the compressor and the right indicates the rear of the compressor.

Formed on the rear housing 14 are a suction chamber 20 and a discharge chamber 22, which are communicated to the cylinder bores 10*a* through a valve unit 18. Also, the front housing 12 and the cylinder block 10 define a crank chamber 24, and axial holes 12*a*, 10*b* are formed on the front housing 12 and the cylinder block 10. A shaft seal device 28 is provided in the axial hole 12*a*. A rubber material is used for the shaft seal device 28. Also, a plain bearing 30 is provided in the axial hole 10*b*. A rear chamber 10*c* communicated to the axial hole 10*b* is formed centrally of a rear end of the cylinder block 10, the rear chamber 10*c* being opposed to the valve unit 18.

The drive shaft 16 is supported by the front housing 12 and the cylinder block 10 in a state to be able to rotate, in which one end thereof is exposed from the front housing 12 and a central portion thereof faces into the crank chamber 24. A pulley and an electromagnetic clutch, both of which are not shown, are connected to the drive shaft 16, and the drive shaft 16 is rotationally driven by a drive source, such as an engine, etc. through a belt stretched round the pulley and the electromagnetic clutch. Also, pistons 32, respectively, are received in the respective cylinder bores 10*a* to be able to reciprocate, the respective pistons 32, respectively, defining compression chambers in the cylinder bores 10*a*.

A lug plate 34 receiving compressive reaction force is fixed to the drive shaft 16 in the crank chamber 24, and a thrust bearing 36 and a plain bearing 38 are provided between the lug plate 34 and the front housing 12. Also, the drive shaft 16 has a swash plate 40 inserted therethrough, of which inclination to an imaginary plane perpendicular to the drive shaft 16 is variable. A hinge portion 34*a* is formed on the lug plate 34 to be directed toward the swash plate 40, a hinge portion 40*a* is provided on the swash plate 34 to be directed toward the lug plate 34, and the hinge portions 34*a*, 40*a* constitute a linkage 42. Also, a push spring 44 is provided between the lug plate 34 and the swash plate 40 to bias the both in a direction, in which the both separate from each other.

Also, pairs of front and rear shoes 46 are provided between the swash plate 40 and the respective pistons 32. The shoe 46 on a front side is provided between a front surface of the swash plate 40 and a front seat surface of the piston 32, and the shoe 46 on a rear side is provided between a rear surface of the swash plate 40 and a rear seat surface of the piston 32. The respective shoes 46 are substantially semi-spherical in shape. The respective shoes 46 serve as a motion conversion mechanism.

Formed on the drive shaft 16 are a first hole 62 and a second hole 64, which extend in a radial direction, a communication hole 66 extending coaxially with an axis in an axial direction to provide communication between the first hole 62 and the second hole 64, and an outflow hole 68 extending from a rear end of the second hole 64 communicated to the communication hole 66 and being coaxial with the communication hole 66 to extend to a rear end of the drive shaft 16. An opening-degree regulating port 68*a* is defined at a boundary of the communication hole 66 and the outflow hole 68.

Figure 5:
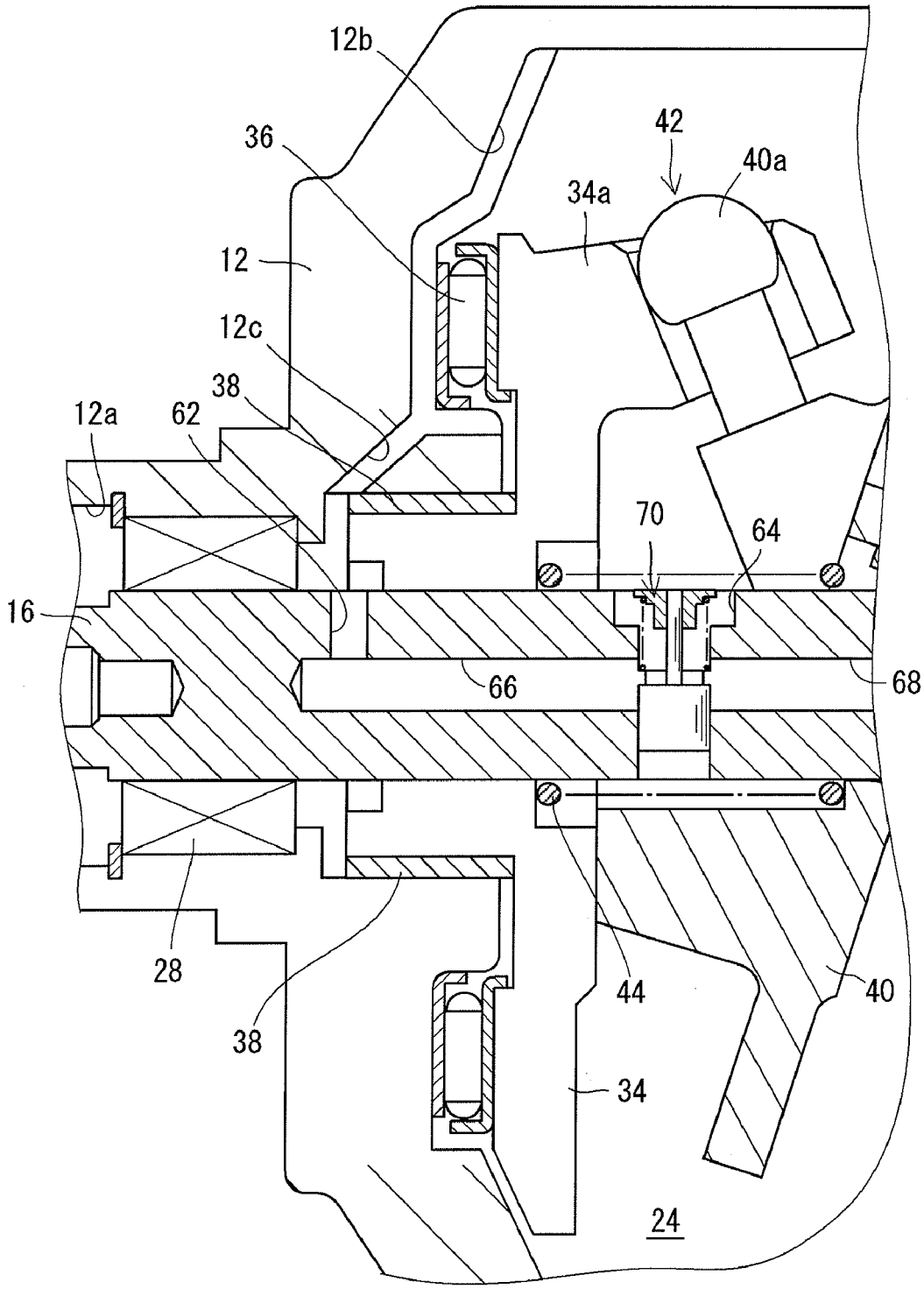
FIG. 5 relates to the swash plate compressor according to EMBODIMENT 1 and is a cross sectional view showing an essential part thereof.

As shown in FIG. 5, the first hole 62 is disposed between the lug plate 34 and the front housing 12 and formed over an extent of a radius of the drive shaft 16 from an axis of the drive shaft 16 to an outer periphery thereof. An oil guide groove 12*b* is formed on the front housing 12 to extend between the front housing 12 and the lug plate 40 from an outer peripheral region of the crank chamber 24 to face the thrust bearing 36. Also, an oil guide hole 12*c* is formed on the front housing 12 to be communicated to the oil guide groove 12*b* to face the plain bearing 38 and the shaft seal device 28. The oil guide hole 12*c* faces the shaft seal device 28 in the axial hole 12*a* to be communicated to the first hole 62. The oil guide groove 12*b* and the oil guide hole 12*c* serve as an oil guide path.

Figure 6:
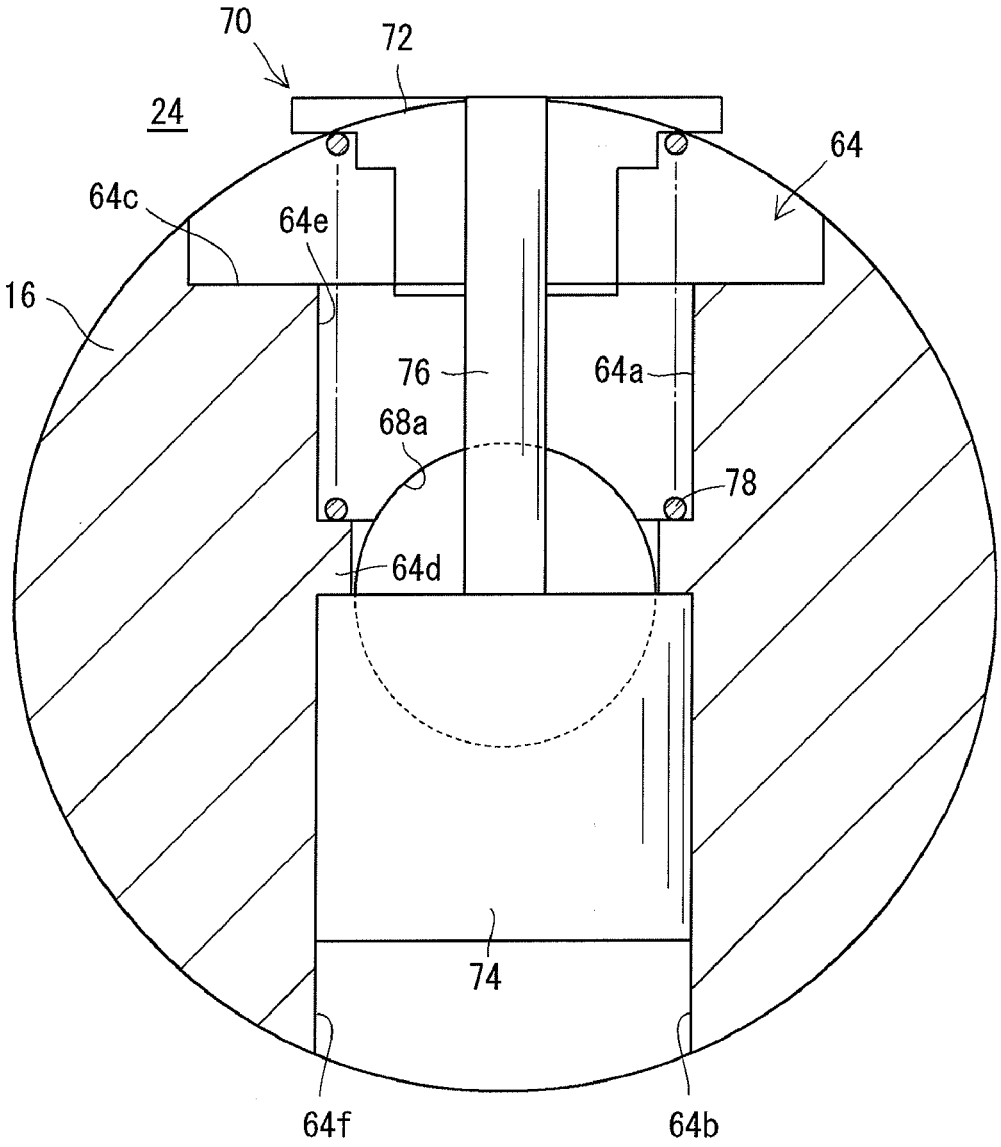
FIG. 6 relates to the swash plate compressor according to EMBODIMENT 1 and is a cross sectional view showing, in enlarged scale, an essential part thereof while a drive shaft is rotated at low speed.
Figure 7:
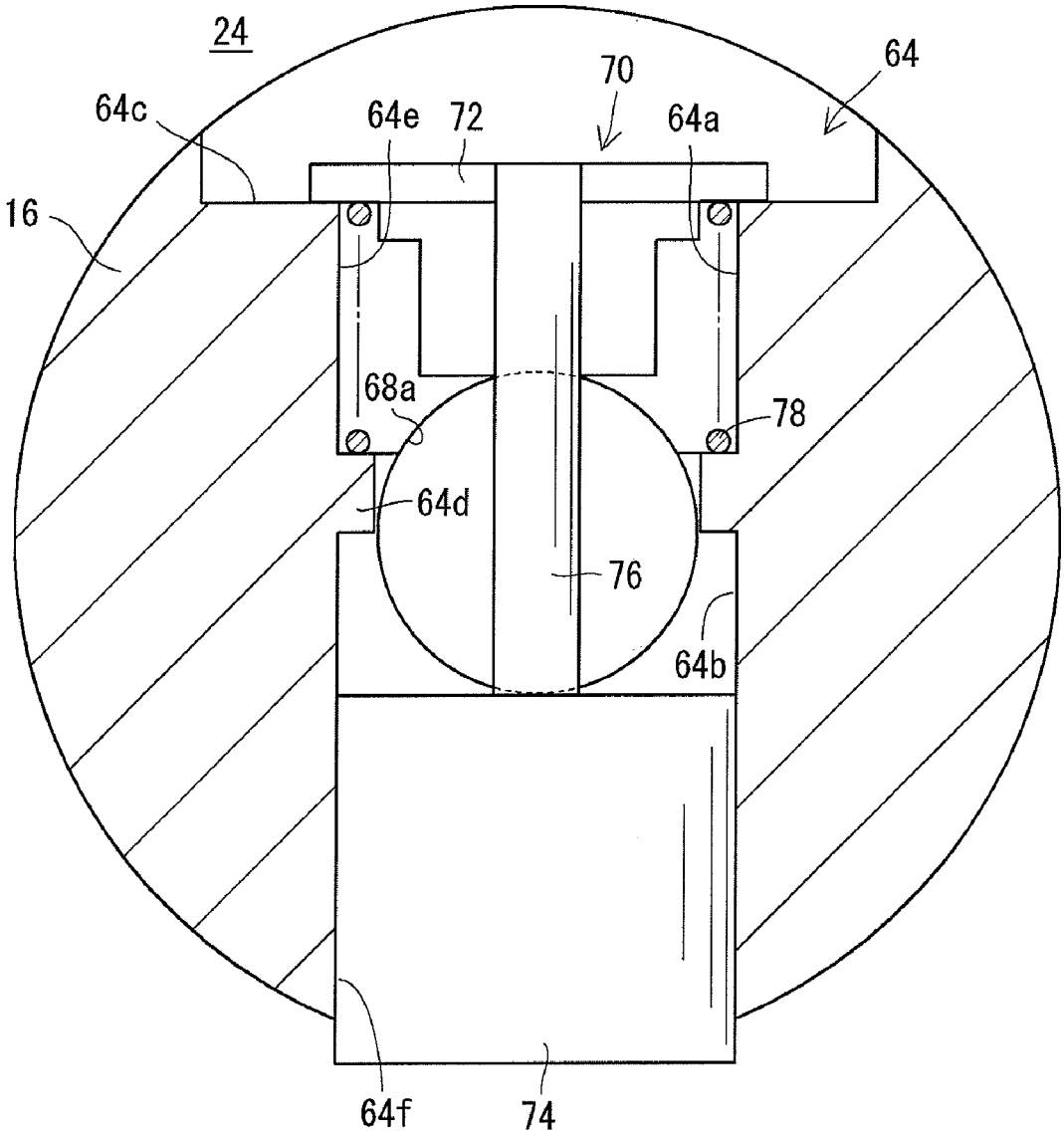
FIG. 7 relates to the swash plate compressor according to EMBODIMENT 1 and is a cross sectional view showing, in enlarged scale, an essential part thereof while the drive shaft is rotated at high speed.

The second hole 64 is provided on and through the drive shaft 16 between the lug plate 34 and the swash plate 40 rearwardly of the first hole 62. As shown in FIGS. 6 and 7, the second hole 64 includes a valve seat 64*c*, a first radial hole 64*a* provided to extend from an axis to be communicated to the crank chamber 24, and a second radial hole 64*b* formed to have the same diameter as that of the first radial hole 64*a*, extended from the opening-degree regulating port 68*a* to an opposite side to the first radial hole 64*a*, and provided to extend to an outer periphery of the drive shaft 16 to be communicated to the crank chamber 24.

The valve seat 64*c* is formed around the first radial hole 64*a*. Also, the first radial hole 64*a* and the second radial hole 64*b* of the second hole 64 are communicated to the outflow hole 68 through the opening-degree regulating port 68*a*. A spring seat 64*d* having a somewhat small diameter is formed between the first radial hole 64*a* and the second radial hole 64*b*. The first radial hole 64*a* includes a first opening 64*e* communicated to the opening-degree regulating port 68*a* and opened to the crank chamber 24 through the spring seat 64*d*. The second radial hole 64*b* includes a second opening 64*f* communicated to the opening-degree regulating port 68*a* and opened to the crank chamber 24. As shown in FIG. 5, the second opening 64*f* is positioned on an opposite side of an axis of the drive shaft 16 to a hinge portion 34*a* of the lug plate 34.

As shown in FIGS. 4 and 5, a valve mechanism 70 is provided on the second hole 64. As shown in FIGS. 6 and 7, the valve mechanism 70 includes a valve body 72 that is positioned toward the first opening 64*e* relative to the axis of the drive shaft 16 and can be seated on the valve seat 64*c*, a mass body 74 that is positioned toward the second opening 64*f* relative to the axis of the drive shaft 16 and can change opening degree of the opening-degree regulating port 68*a*, a connecting bar 76 that connects the valve body 72 and the mass body 74 so as to make the valve body 72 movable, and a bias spring 78 that biases the valve body 72 so as to have the same opening the first opening 64*e*. The valve body 72 is received in the first radial hole 64*a* and the mass body 74 is received in the second radial hole 64*b*. The valve body 72 and the connecting bar 76 are formed from a lighter material than that of the mass body 74. The spring 78 is provided between the valve body 72 and the spring seat 64*d*.

Also, as shown in FIG. 4, the rear end of the drive shaft 16 projects into the receiving chamber 10*c* and a cylindrical-shaped spacer 80 is fitted onto an outer peripheral surface of the rear end of the drive shaft 16. The spacer 80 biases the drive shaft 16 forward while coming into sliding contact with the valve unit 18. Provided on the valve unit 18 to extend therethrough is a throttle hole 18*a* that communicates an interior of the spacer 80 to the suction chamber 20. The oil guide groove 12*b*, the oil guide hole 12*c*, the first hole 62, the second hole 64, the communication port 66, the outflow hole 68, and the throttle hole 18*a* constitute a release passage. The oil guide groove 12*b* the oil guide hole 12*c*, the first hole 62, the communication port 66, the outflow hole 68, and the throttle hole 18*a* constitute a first passage. Also, the second hole 64, the outflow hole 68, and the throttle hole 18*a* constitute a second passage.

Also, a capacity control valve 48 is received in the rear housing 14. The capacity control valve 48 is communicated to the suction chamber 20 through a detection passage 50 and provides communication between the discharge chamber 22 and the crank chamber 24 through the supply passage 52. The capacity control valve 48 detects pressure in the suction chamber 20 to change opening degree of the supply passage 52 to change the discharge capacity of a compressor.

A substantially columnar-shaped storage chamber 54 is defined in the rear housing 14 and a cylindrical-shaped cylinder 54*a* projects downward into the storage chamber 54. The cylinder 54*a* serves as an oil separator. The suction chamber 22 and the storage chamber 54 are communicated to each other through a discharge passage 22*a*, the discharge passage 22*a* facing an upper portion of the cylinder 54*a* in the storage chamber 54. An interior of the cylinder 54*a* serves as a discharge port 54*b*. An oil return passage 52*a* communicated to the capacity control valve 48 is defined at a bottom of the storage chamber 54, the oil return passage 52*a* being communicated to the crank chamber 24 through the supply passage 52 via the capacity control valve 48. Provided on the capacity control valve 48 are a known valve body and a valve seat to define a throttle between the valve body and the valve seat. The oil return passage 52*a* together with the storage chamber 54 and the discharge passage 22*a* constitutes a part of the supply passage 52 communicated to the crank chamber 24 from discharge chamber 22.

A pipe 56 is connected to the discharge port 54*b*, the pipe 56 being connected to the suction chamber 20 through a check valve 57, a condenser 58, an expansion valve 59, and an evaporator 60. The compressor, the check valve 57, the condenser 58, the expansion valve 59, the evaporator 60, and the pipe 56 constitute a refrigerating circuit. Refrigerating gas mixed with lubricating oil is charged in the refrigerating circuit.

With the compressor thus constructed, the capacity control valve 48 adjusts pressure in the crank chamber 24 on the basis of pressure in the suction chamber 20 and a flow rate of refrigerating gas to change an angle of the swash plate 40 to the drive shaft 16 to change a discharge capacity thereof.

Also, with the compressor, when the drive shaft 16 is rotated at high speed while a vehicle is running at high speed, the mass body 74 of the valve mechanism 70 undergoes large centrifugal force to move away from the axis of the drive shaft 16 against the bias of the spring 78, whereby the valve body 72 decreases opening degree of the first opening 64*e* as shown in FIG. 7. When the drive shaft 16 is rotated at a further high speed, the valve body 72 is seated on the valve seat 64*c*.

Figure 8:
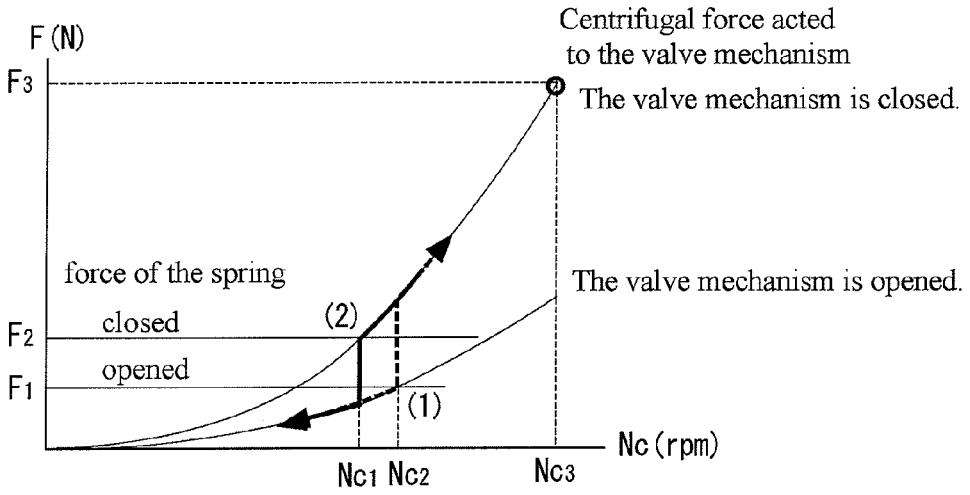
FIG. 8 relates to the swash plate compressor according to EMBODIMENT 1 and is a graph illustrating the relationship between the rotating speed of the drive shaft and force.

With the compressor, the relationship between the rotating speed Nc(rpm) of the drive shaft 16 and force F(N) is demonstrated as shown in FIG. 8 by setting the mass of the valve body 72, the connecting bar 76, and the mass body 74 and the bias of the spring 78. That is, as indicated by a broken line (1), in the case where the rotating speed gradually increases, the valve body 72 is seated on the valve seat 64*c* at the rotating speed $Nc_2$. Conversely, as indicated by a solid line (2), in the case where the rotating speed gradually decreases, the valve body 72 separates from the valve seat 64*c* at the rotating speed $Nc_1$.

Therefore, opening degree, at which the second hole 64 is communicated to the opening-degree regulating port 68*a*, decreases and opening degree, at which the first hole 62 shown in FIG. 5 is communicated to the opening-degree regulating port 68*a*, increases. That is, the single valve mechanism 70 increases a ratio, at which the first hole 62 occupies the release passage, and decreases a ratio, at which the second hole 64 occupies the release passage.

In an outer peripheral region of the crank chamber 24, lubricating oil is present in abundance and the lubricating oil is led to the first hole 62 through the oil guide groove 12*b* and the oil guide hole 12*c*. At this time, the lubricating oil is led to the first hole 62 through the shaft seal device 28, so that a large quantity of the lubricating oil is supplied to the shaft seal device 28 to heighten a rubber material of the shaft seal device 28 in durability.

Owing to the first hole 62 increased in that ratio, at which it occupies the release passage, refrigerating gas disposed in the crank chamber 24 and containing a large quantity of the lubricating oil are led to the suction chamber 20 through the communication port 66, the outflow hole 68, and the throttle hole 18*a*. Therefore, the lubricating oil in the crank chamber 24 becomes moderate in quantity and so the swash plate 40 does not agitate the lubricating oil so much, so that the lubricating oil is hard to generate heat due to shearing and hard to decrease in viscosity. Therefore, sliding portions between the swash plate 40 and the respective shoes 46 are favorably lubricated. Also, refrigerating gas sucked from the suction chamber 20 contain a large quantity of the lubricating oil and sliding portions between the cylinder bores 10*a* and the pistons 32 are favorably lubricated. Thereby, an excellent durability exhibits itself at high speed.

In addition, while the lubricating oil contained in refrigerating gas discharged to the refrigerating circuit outside the compressor are increased in quantity at this time, no problem is caused in refrigerating capacity since the pistons 32 reciprocate at high speed.

Also, when the drive shaft 16 is rotated at low speed while a vehicle is running at low speed, or the like, the mass body 74 of the valve mechanism 70 yields to the bias of the spring 78 because of small centrifugal force to approach the axis of the drive shaft 16 as shown in FIG. 6, and thus the valve body 72 increases opening degree of the first opening 64*e*. When the drive shaft 16 is rotated at a further low speed, the mass body 74 abuts against a back side of the spring seat 64*d* to close only a half of the opening-degree regulating port 68*a*.

Therefore, opening degree, at which the second hole 64 is communicated to the opening-degree regulating port 68*a*, increases and opening degree, at which the first hole 62 shown in FIG. 5 is communicated to the opening-degree regulating port 68*a*, decreases. That is, the single valve mechanism 70 decreases a ratio, at which the first hole 62 occupies the release passage, and increases a ratio, at which the second hole 64 occupies the release passage.

The lubricating oil is small in quantity in an inner peripheral region of the crank chamber 24, that is, a region close to the drive shaft 16, and refrigerating gas not containing much of the lubricating oil are led into the second hole 64 from there.

Owing to the second hole 64 increased in that ratio, at which it occupies the release passage, refrigerating gas not containing much of the lubricating oil within the crank chamber 24 are moved to the suction chamber 20 via the outflow hole and the throttle hole 18*a*. Therefore, the lubricating oil contained in refrigerating gas discharged to the refrigerating circuit outside the compressor are decreased in quantity, so that a high refrigerating capacity exhibits itself.

In addition, while the lubricating oil in the crank chamber 24 is increased in quantity at this time, the swash plate 40 or the like only agitates the lubricating oil at low speed, so that the lubricating oil is little raised in temperature and the lubricating oil is not decreased so much in viscosity. Therefore, sliding portions are still lubricated favorably.

On the other hand, with the compressor, the swash plate 40 is supported to be variable in inclination angle and the capacity control valve 48 increases pressure in the crank chamber 24 to change a discharge capacity thereof. Here, since the first radial hole 64*a* and the second radial hole 64*b* of the second hole 64 are the same in diameter with each other, the valve body 72 is received in the first radial hole 64*a*, and the mass body 74 is received in the second radial hole 64*b*, pressure in the crank chamber 24 does not generate a pressure difference between the valve body 72 and the mass body 74 and so the valve body 72 operates stably. Also, since the valve body 72 is received in the first radial hole 64*a* and the mass body 74 is received in the second radial hole 64*b*, the valve mechanism 70 does not obstruct the way in the crank chamber 24. Further, since the mass body 74 changes opening degree of the opening-degree regulating port 68*a*, there is no need of providing any separate valve body that changes opening degree of the opening-degree regulating port 68*a*, and the valve mechanism 70 can be made simple in construction.

Also, the rotating speed $Nc_2$ of the drive shaft 16 when the valve body 72 is seated on the valve seat 64*c* as shown in FIG. 8 is higher than the rotating speed $Nc_1$ of the drive shaft when the valve body 72 separates from the valve seat 64*c*. Therefore, the valve body 72, opening degree of which is medium, is hard to vibrate and the valve body 72 is decreased in the number of operation, so that the valve body 72 is hard to abrade and can demonstrate a high durability.

Also, with the compressor, the second opening 64*f* is positioned on an opposite side of an axis of the drive shaft 16 to the hinge portion 34*a* of the lug plate 34 as shown in FIG. 5, or the like, so that motions of the valve body 72 caused by centrifugal force are made high in accuracy and introduction of refrigerating gas from the first opening 64*e* is not obstructed.

With the compressor, refrigerating gas are discharged to the storage chamber 54 from the discharge chamber 22 as shown in FIG. 4 and the cylinder 54*a* separates lubricating oil from the refrigerating gas. The lubricating oil as separated are led to the crank chamber 24 through the oil return passage 52*a*, the capacity control valve 48, and the supply passage 52. That is, the lubricating oil is throttled in the capacity control valve 48 and then returned to the crank chamber 24. Therefore, when the discharge capacity is varied to a small degree, a moderate quantity of lubricating oil is ensured in the crank chamber 24 even when the lubricating oil in the crank chamber 24 flows to the suction chamber 20 via the first hole 62 or the like, since the crank chamber 24 is high in pressure and the suction chamber 20 is low in pressure. When the drive shaft 16 is rotated at high speed, however, the single valve mechanism 70 increases a ratio, at which the first hole 62 occupies the release passage, and decreases a ratio, at which the second hole 64 occupies the release passage, so that the lubricating oil is not excessively supplied into the crank chamber 24.

Figure 9:
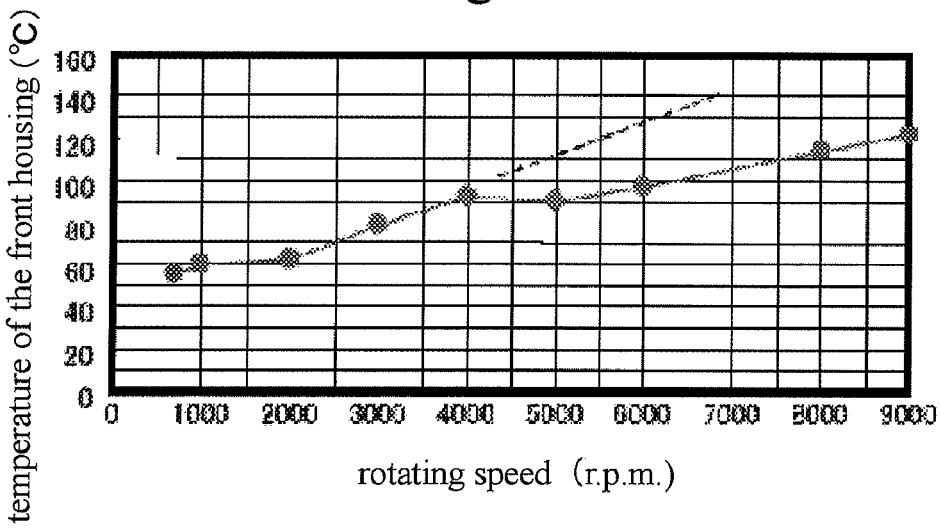
FIG. 9 relates to the swash plate compressor according to EMBODIMENT 1 and is a graph illustrating the relationship between the rotating speed of the drive shaft and a temperature of a front housing.

FIG. 9 shows the relationship between the rotating speed Nc(rpm) of the drive shaft 16 and temperature (° C.) of the front housing 12 in the compressor of EMBODIMENT 1. It is found in FIG. 9 that even when the rotating speed increases, the front housing 12 is not increased so much in temperature.

Figure 10:
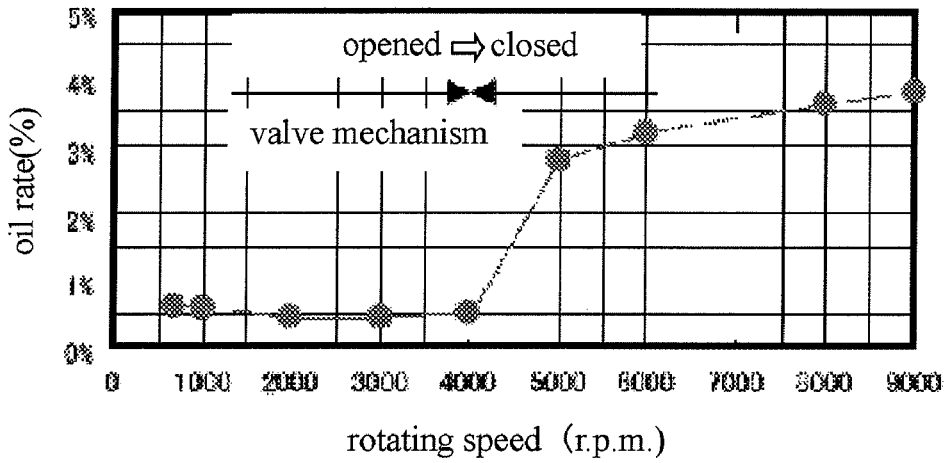
FIG. 10 relates to the swash plate compressor according to EMBODIMENT 1 and is a graph illustrating the relationship between the rotating speed of the drive shaft and an oil rate.

Also, FIG. 10 shows the relationship between the rotating speed Nc (rpm) of the drive shaft 16 and an oil rate (%) in the compressor of EMBODIMENT 1. It is found in FIG. 10 that the oil rate is changed when a predetermined value of the rotating speed is reached. In addition, the oil rate is measured between the evaporator 60 and the compressor.

Accordingly, the compressor can realize demonstration of an excellent sliding characteristic when the drive shaft 16 is rotated at high speed, and demonstration of a high refrigerating capacity when the drive shaft 16 is rotated at low speed.

Embodiment 2

With a swash plate compressor according to EMBODIMENT 2, a second hole 81 is formed over an extent of a radius of the drive shaft 16 from an axis of the drive shaft 16 to an outer periphery thereof. A communication hole 82 extends coaxially with an axis in an axial direction to provide communication between the first hole 62 and the second hole 81. An outflow hole 83 extends to the rear end of the drive shaft 16 coaxially with the communication hole 82 from a rear end of the second hole 81 communicated to the communication hole 82.

Figure 11:
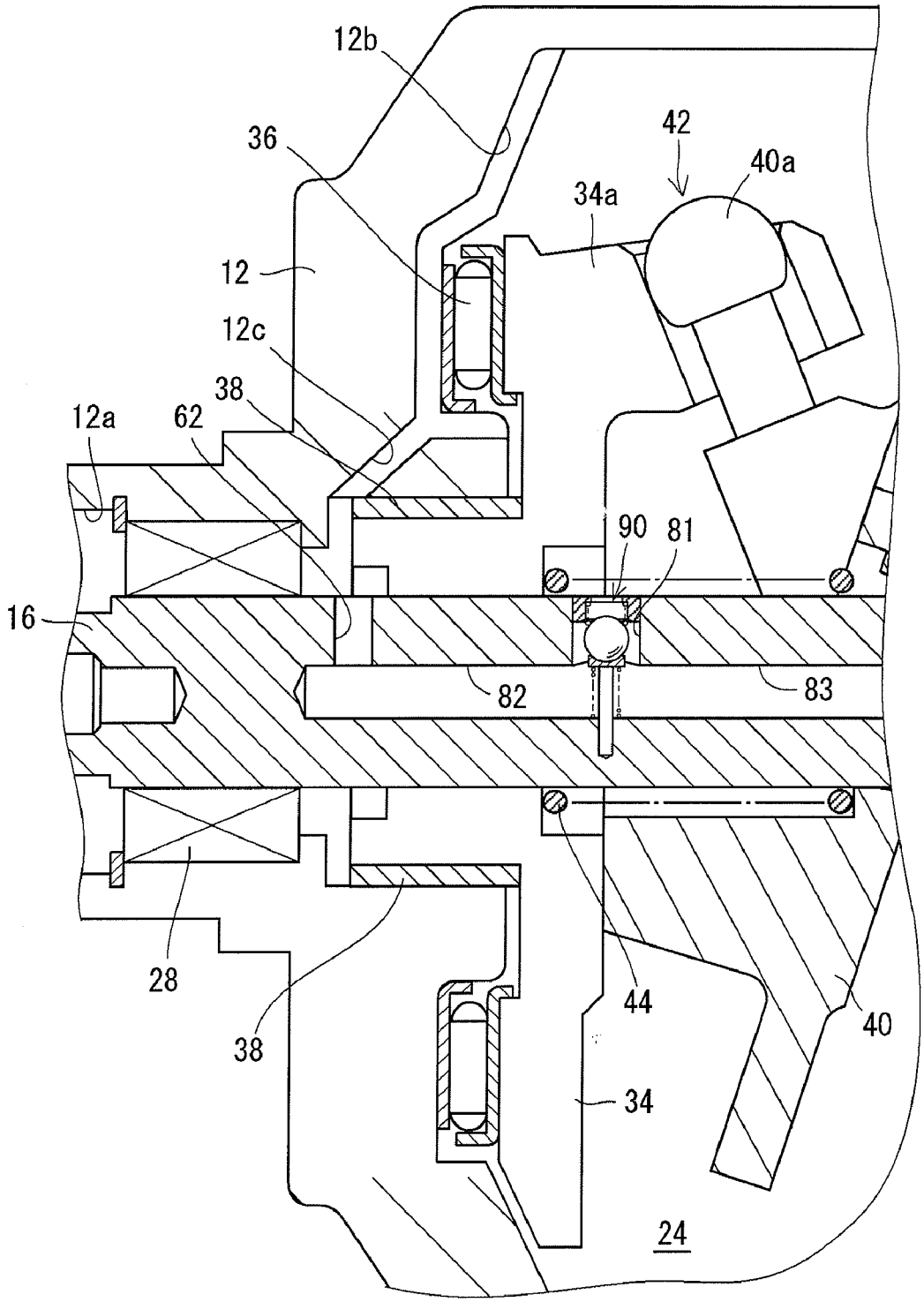
FIG. 11 relates to a swash plate compressor according to EMBODIMENT 2 and is a cross sectional view showing an essential part thereof.
Figure 12:
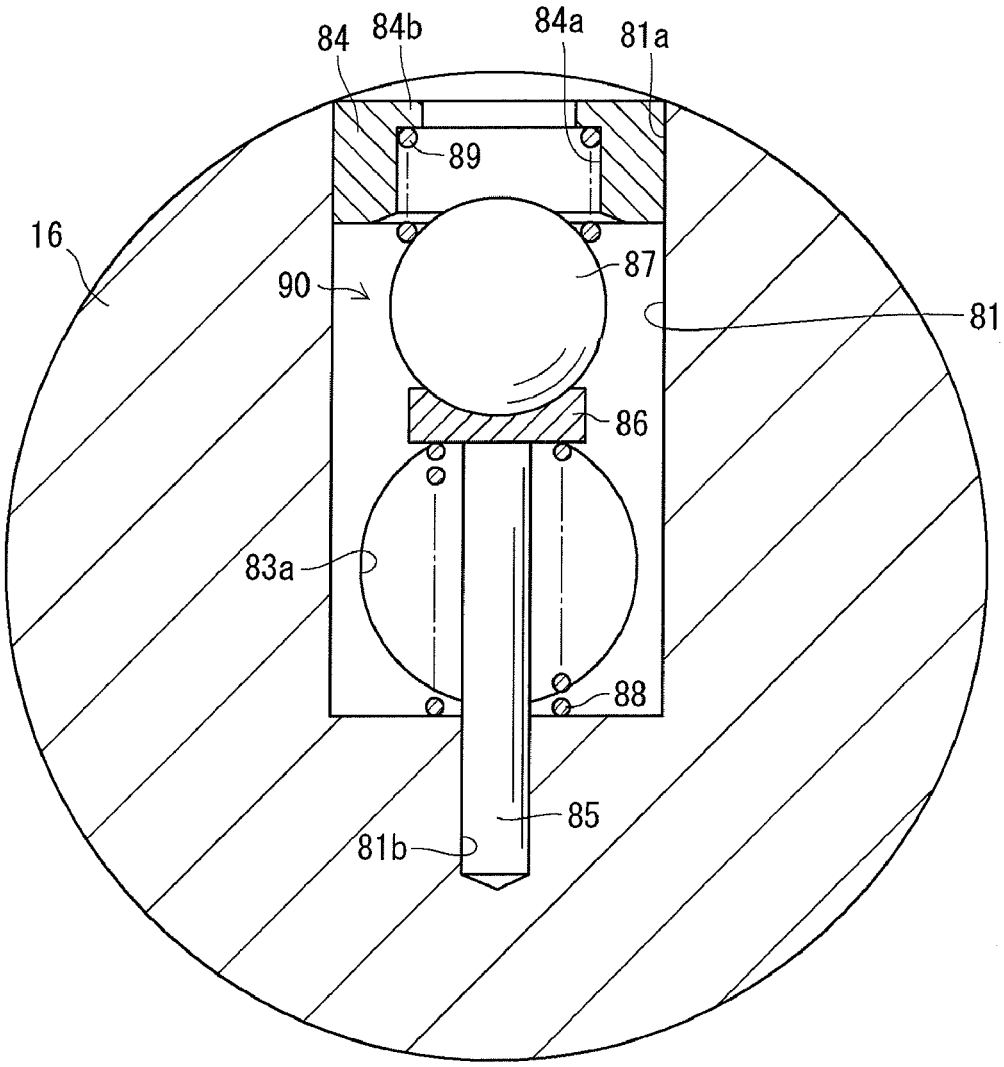
FIG. 12 relates to the swash plate compressor according to EMBODIMENT 2 and is a cross sectional view showing, in enlarged scale, an essential part thereof while a drive shaft is rotated at low speed.
Figure 13:
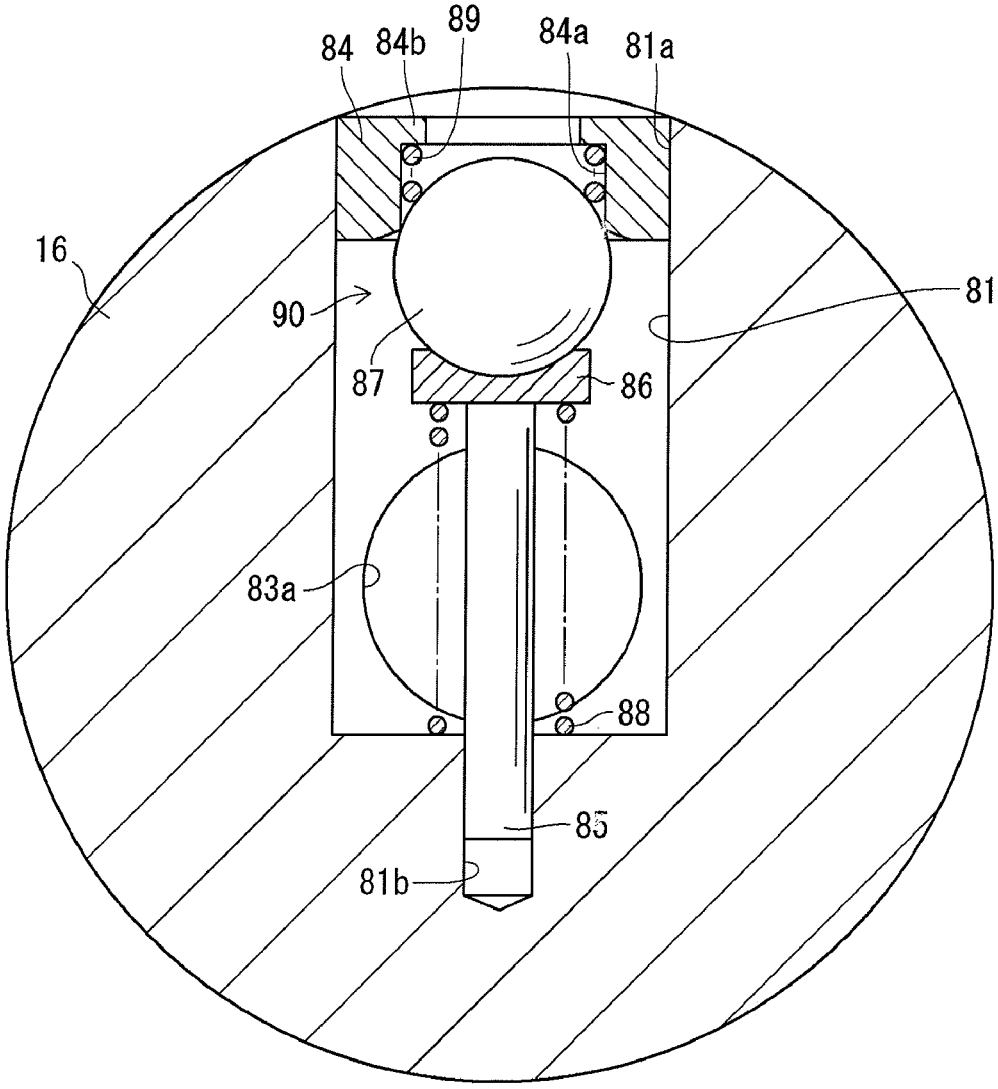
FIG. 13 relates to the swash plate compressor according to EMBODIMENT 2 and is a cross sectional view showing, in enlarged scale, an essential part thereof while the drive shaft is rotated at high speed.

As shown in FIGS. 12 and 13, the second hole 81 includes an opening-degree regulating port 83*a* communicated to the outflow hole 83, and a first opening 81*a* communicated to the opening-degree regulating port 83*a* to be opened to one end side thereof, and a guide hole 81*b*concavely provided at a bottom surface on an opposite side to the first opening 81*a* to be coaxial with the first opening 81*a*. The opening-degree regulating port 83*a* is defined at a boundary of the communication hole 82 and the outflow hole 83. A valve seat 84 is fixed to a side of the second hole 81 toward the first opening 81*a*. A valve hole 84*a* is formed on the valve seat 84 to extend radially of the drive shaft 16 and a spring seat 84*b* of a small diameter is formed on the valve seat 84 toward the first opening 81*a*. As shown in FIG. 11, the oil guide groove 12*b*, the oil guide hole 12*c*, the first hole 62, the second hole 81, the communication port 82, the outflow hole 83, and the throttle hole 18*a* constitute a release passage. The oil guide groove 12*b*, the oil guide hole 12*c*, the first hole 62, the communication port 82, the outflow hole 83, and the throttle hole 18*a* constitute a first passage. Also, the second hole 81, the outflow hole 83, and the throttle hole 18*a* constitute a second passage.

As shown in FIGS. 12 and 13, an valve mechanism 90 is provided on the second hole 81. The valve mechanism 90 includes a guide bar 85 provided slidably in the guide hole 81*b*, a spring seat 86 provided at a tip end of the guide bar 85 to be integral with the guide bar 85, and a spherical-shaped valve body 87 held at a tip end of the spring seat 86. The valve body 87 serves also as a mass body. Provided between the spring seat 86 and a bottom surface of the second hole 81 is a first spring 88 that biases the valve body 87 toward the first opening 81*a*. Also, provided between the valve body 87 and the spring seat 84*b* of the valve seat 84 is a second spring 89 that biases the valve body 87 toward the opening-degree regulating port 83*a*.

Pushing force f1 of the first spring 88 and pushing force f2 of the second spring 89 have the following relationship of Formula 1 where m indicates a mass of the valve body 87, Rmin indicates a minimum rotating speed of the drive shaft 16, Rmax indicates a maximum rotating speed of the drive shaft 16, and ω indicates a rotating speed of the drive shaft 16, at which the valve body 87 closes the second hole 81.

$$m \cdot Rmin \cdot \omega^2 \leqq f2 - f1 \leqq m \cdot Rmax \cdot \omega^2 \quad \text{(Formula 1)}$$

With the compressor, according to the relationship of Formula 1, even when a distance from the axis to the valve body 87 is small, the drive shaft 16 is high in rotating speed when the valve body 87 is seated on the valve seat 84. The remainder of the construction is the same as that of EMBODIMENT 1.

With the compressor, when the drive shaft 16 is rotated at high speed while a vehicle is running at high speed, or the like, the valve body 87 of the valve mechanism 90 is caused by large centrifugal force and the bias of the first spring 88 to get away from the axis of the drive shaft 16 against the bias of the second spring 89, whereby the valve body 87 decreases opening degree of the valve hole 84*a* as shown in FIG. 13. When the drive shaft 16 is rotated at a further high speed, the valve body 87 is seated on the valve seat 84.

Therefore, opening degree, at which the second hole 81 is communicated to the opening-degree regulating port 83*a*, decreases and opening degree, at which the first hole 62 shown in FIG. 11 is communicated to the opening-degree regulating port 83*a*, increases. That is, the single valve mechanism 90 increases a ratio, at which the first hole 62 occupies the release passage, and decreases a ratio, at which the second hole 81 occupies the release passage.

Also, when the drive shaft 16 is rotated at low speed while a vehicle is running at low speed, or the like, the valve body 87 of the valve mechanism 90 is caused by the bias of the second spring 89 to approach the axis of the drive shaft 16 against small centrifugal force and the bias of the first spring 88, and thus the valve body 87 increases opening degree of the valve hole 84*a* as shown in FIG. 12.

Therefore, opening degree, at which the second hole 81 is communicated to the opening-degree regulating port 83*a*, increases and opening degree, at which the first hole 62 shown in FIG. 11 is communicated to the opening-degree regulating port 83*a*, decreases. That is, the single valve mechanism 90 decreases a ratio, at which the first hole 62 occupies the release passage, and increases a ratio, at which the second hole 81 occupies the release passage.

Thus, since the valve body 87, opening degree of which is medium, is held by the first and second springs 88, 89, the compressor is further hard to abrade and can demonstrate a high durability. Also, since the valve body 87 is received in the second hole 81, the valve mechanism 90 does not obstruct the way in the crank chamber 24. The remaining function and effect are the same as those of EMBODIMENT 1.

Embodiment 3

Figure 14:
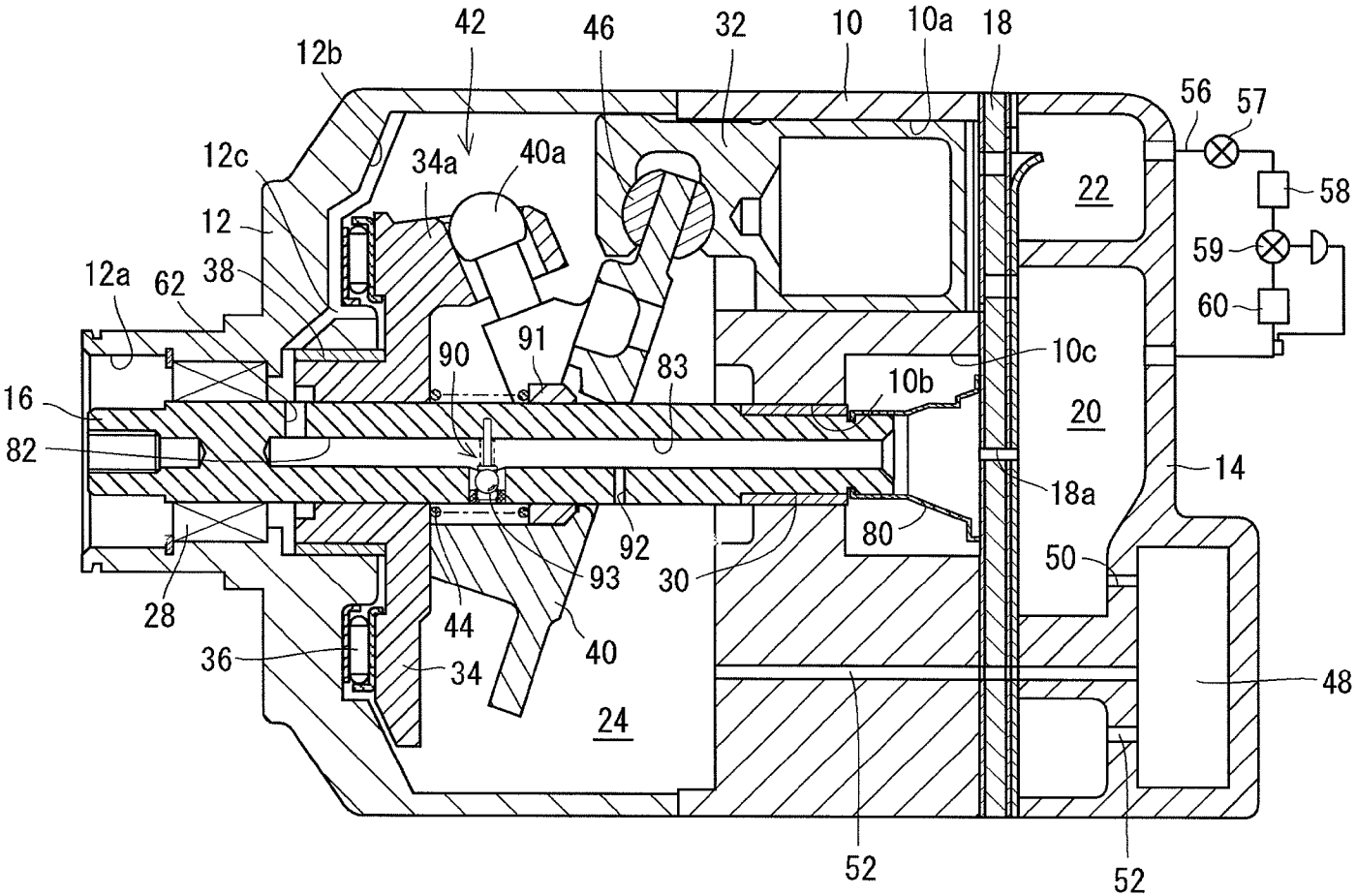
FIG. 14 is a cross sectional view showing a swash plate compressor according to EMBODIMENT 3.
Figure 15:
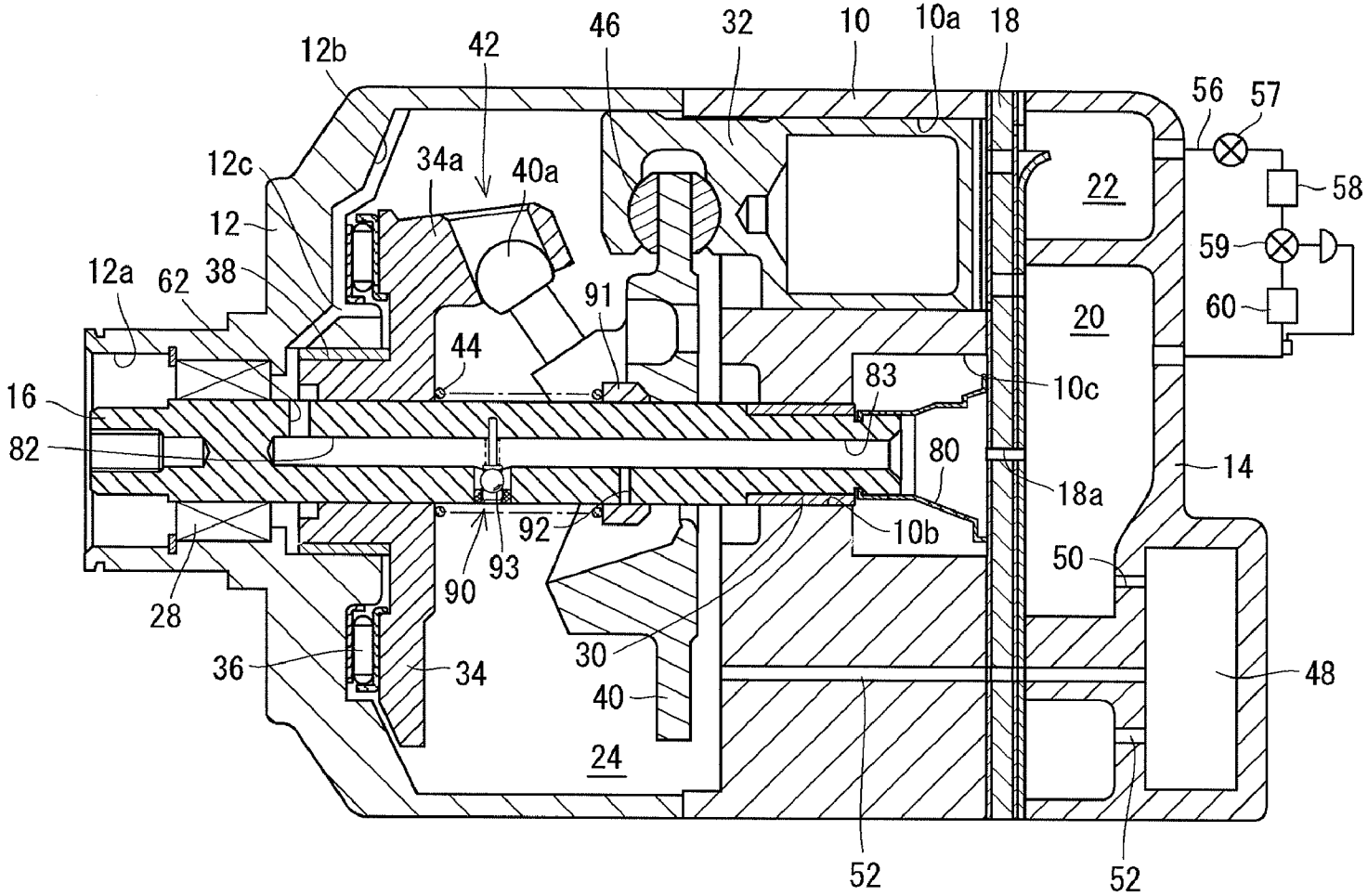
FIG. 15 is a cross sectional view showing the swash plate compressor according to EMBODIMENT 3.

With a swash plate compressor according to EMBODIMENT 3, a second hole comprises a first introduction hole 93 and a second introduction hole 92 as shown in FIGS. 14 and 15. The first introduction hole 93 is the same as the second hole 81 of EMBODIMENT 2 and formed radially on a drive shaft 16 to be provided with the valve mechanism 90 of EMBODIMENT 2. The second introduction hole 92 is formed radially of the drive shaft 16 rearwardly of the first introduction hole 93 to be communicated to an outflow hole 83. No valve mechanism is formed on the second introduction hole 92. An oil guide groove 12*b*, an oil guide hole 12*c*, a first hole 62, the first introduction hole 93, the second introduction hole 92, a communication port 82, an outflow hole 83, and a throttle hole 18*a* constitute a release passage. The oil guide groove 12*b*, the oil guide hole 12*c*, the first hole 62, the communication port 82, the outflow hole 83, and the throttle hole 18*a* constitute a first passage. Also, the first introduction hole 93, the second introduction hole 92, the outflow hole 83, and the throttle hole 18*a* constitute a second passage.

Provided on the drive shaft 16 is a sleeve 91 that moves in an axial direction of the drive shaft 16 as a swash plate 40 is varied in inclination angle, thus enabling to change opening degree of the second introduction hole 92. A push spring 44 is provided between a lug plate 34 and the sleeve 91 to bias the same in a direction, in which the both separate from each other. In addition, depiction of an oil separator is omitted.

With the compressor, when the drive shaft 16 is rotated at high speed and the discharge capacity is 100% as shown in FIG. 14, the first introduction hole 93 is small in opening degree (see FIG. 13) but the second introduction hole 92 is large in opening degree. That is, a ratio, at which the first hole 62 occupies the release passage, increases and a ratio, at which the first introduction hole 93 occupies the release passage, decreases, so that a ratio, at which the second introduction hole 92 occupies the release passage, is maintained. Since the second hole comprises the first introduction hole 93 and the second introduction hole 92, a ratio, at which the second hole occupies the release passage, becomes medium.

Also, as shown in FIG. 15, when the drive shaft 16 is rotated at high speed and the discharge capacity is varied to a small degree, the first introduction hole 93 is small in opening degree (see FIG. 13) and the second introduction hole 92 is small in opening degree. That is, a ratio, at which the first hole 62 occupies the release passage, increases and a ratio, at which the first introduction hole 93 occupies the release passage, decreases, so that a ratio, at which the second introduction hole 92 occupies the release passage, decreases. Since the second hole comprises the first introduction hole 93 and the second introduction hole 92, a ratio, at which the second hole occupies the release passage, becomes small. At this time, since lubricating oil in an outer peripheral region of the crank chamber 24 is led to the suction chamber 20 only through the oil guide groove 12*b*, the oil guide hole 12*c*, the first hole 62, and the outflow hole 83, a large quantity of the lubricating oil is supplied to a shaft seal device 28 to further heighten a rubber material of the shaft seal device in durability.

On the other hand, when the drive shaft 16 is rotated at low speed and the discharge capacity is 100% as shown in FIG. 14, the first introduction hole 93 is large in opening degree (see FIG. 12) and the second introduction hole 92 becomes large in opening degree. That is, a ratio, at which the first hole 62 occupies the release passage, decreases and a ratio, at which the first introduction hole 93 occupies the release passage, increases, so that a ratio, at which the second introduction hole 92 occupies the release passage, is maintained. Since the second hole comprises the first introduction hole 93 and the second introduction hole 92, a ratio, at which the second hole occupies the release passage, becomes large.

Also, as shown in FIG. 15, when the drive shaft 16 is rotated at low speed and the discharge capacity is varied to a small degree, the first introduction hole 93 is large in opening degree (see FIG. 12) and the second introduction hole 92 becomes small in opening degree. That is, a ratio, at which the first hole 62 occupies the release passage, decreases and a ratio, at which the first introduction hole 93 occupies the release passage, increases, so that a ratio, at which the second introduction hole 92 occupies the release passage, decreases. Since the second hole comprises the first introduction hole 93 and the second introduction hole 92, a ratio, at which the second hole occupies the release passage, becomes medium.

Thus, with the compressor, according to the rotating speed of the drive shaft 16, the function and effect can be produced by the inclination angle of the swash plate 40 while the function and effect of the invention can be produced. The remaining function and effect are the same as those of EMBODIMENT 1.

Embodiment 4

Figure 16:
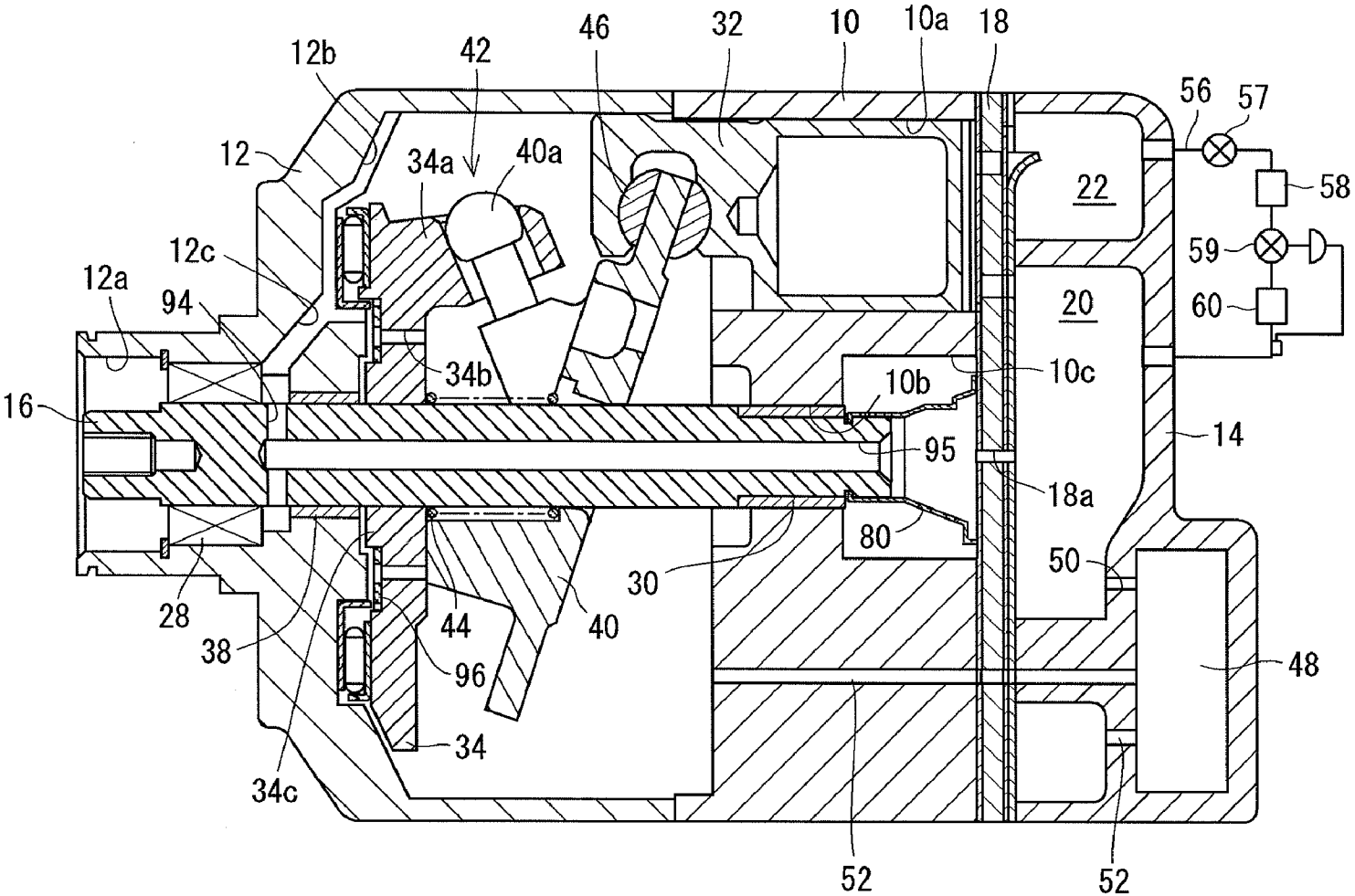
FIG. 16 is a cross sectional view showing a swash plate compressor according to EMBODIMENT 4.

With a swash plate compressor according to EMBODIMENT 4, a drive shaft 16 is formed with a common hole 94 and an outflow hole 95 as shown in FIG. 16. The common hole 94 is provided radially of the drive shaft 16 to be positioned a little rearwardly of a shaft seal device 28. The outflow hole 95 is provided through the drive shaft 16 to extend to a rear end thereof and to be coaxial with an axis of the drive shaft 16.

Figure 17:
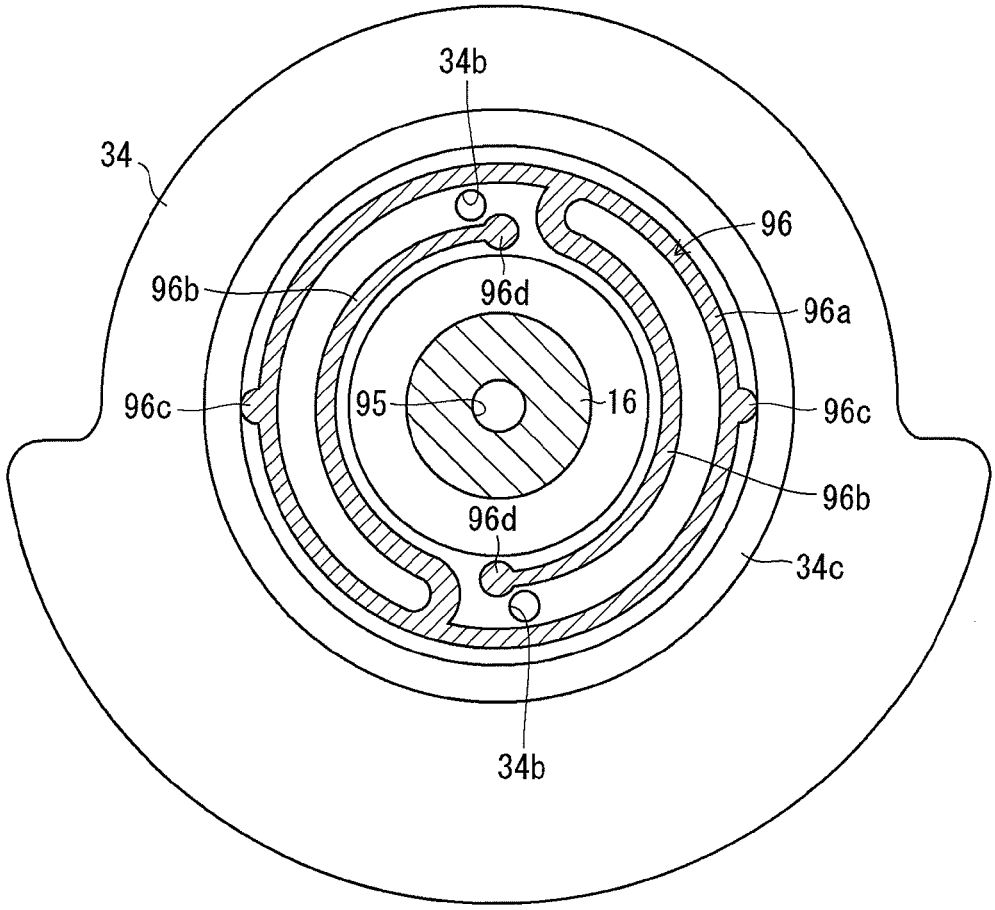
FIG. 17 relates to the swash plate compressor according to EMBODIMENT 4 and is a cross sectional view showing, in enlarged scale, an essential part thereof while a drive shaft is rotated at low speed.
Figure 18:
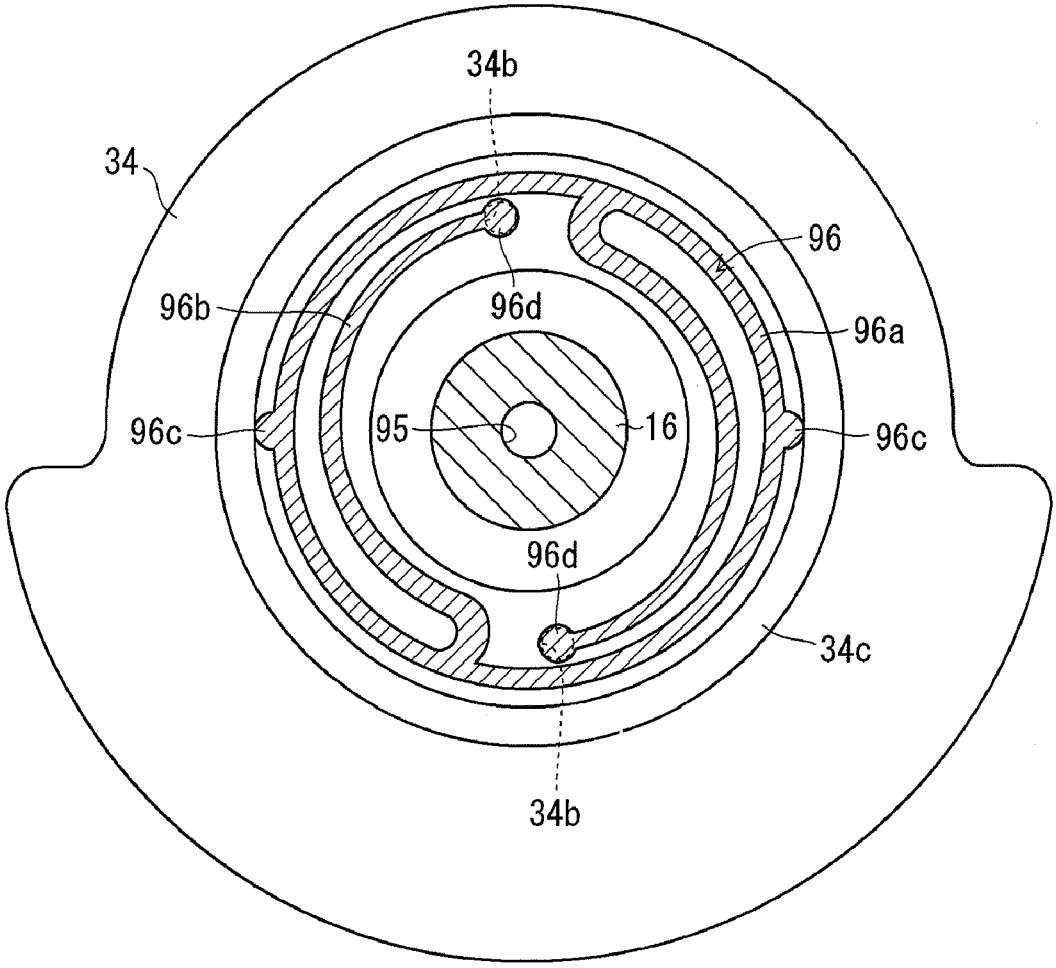
FIG. 18 relates to the swash plate compressor according to EMBODIMENT 4 and is a cross sectional view showing, in enlarged scale, an essential part thereof while the drive shaft is rotated at high speed.

Two through-holes 34*b* extending in parallel to the axis of the drive shaft 16 are provided on an inner periphery of a lug plate 34. The respective through-holes 34*b* are communicated to an oil guide hole 12*c* through between the lug plate 34 and a front housing 12. As shown in FIGS. 17 and 18, the respective through-holes 34*b* are provided in symmetrical positions with the axis of the drive shaft 16 therebetween. An oil guide groove 12*b*, the oil guide hole 12*c*, the common hole 94, the through-holes 34*b*, an outflow hole 95, and a throttle hole 18*a* constitute a release passage as shown in FIG. 16. The oil guide groove 12*b*, the oil guide hole 12*c*, the common hole 94, the outflow hole 95, and the throttle hole 18*a* constitute a first passage. Also, the both through-holes 34*b*, the oil guide hole 12*c*, the common hole 94, the outflow hole 95, and the throttle hole 18*a* constitute a second passage.

Also, an valve mechanism 96 is fixed on a side of the lug plate 34 toward a front housing 12 as shown in FIGS. 17 and 18. The valve mechanism 96 includes an annulus ring portion 96*a* that is coaxial with the axis of the drive shaft 16 and annular in shape, and a pair of lead portions 96*b* bending and extending toward the axis of the drive shaft 16 from the annulus ring portion 96*a* to be coaxial with the axis of the drive shaft 16 to be semi-annular in shape. A pair of projections 96*c* are formed on an outer surface of the annulus ring portion 96*a* to project in a direction away from each other, the both projections 96*c* being fitted into bosses 34*c* of the lug plate 34. Expanded portions 96*d*, respectively, are formed on tip ends of the respective lead portions 96*b*, the respective expanded portions 96*d* being positioned in symmetrical positions with the axis of the drive shaft 16 therebetween. The respective expanded portions 96*d* are mass bodies. The lead portions 96*b* are displaced by centrifugal force in a direction away from the axis whereby the respective expanded portions 96*d* can close the through-holes 34*b*. In addition, depiction of an oil separator is omitted. The remainder of the construction is the same as that of EMBODIMENT 1.

With the compressor, as shown in FIG. 18, as the drive shaft 16 is increased in rotating speed, the both lead portions 96*b* of the valve mechanism 96 separate from the axis against elastic forces of themselves and the both expanded portions 96*d* decrease opening degree of the both through-holes 34*b*.

Also, as shown in FIG. 17, as the drive shaft 16 is decreased in rotating speed, the both lead portions 96*b* of the valve mechanism 96 approach the axis owing to elastic forces of themselves and the both expanded portions 96*d* increase opening degree of the both through-holes 34*b*.

Thus, with the compressor, the mechanical valve mechanism 96 can be provided on the lug plate 34, which is large in a radial direction, and a large distance from the axis of the drive shaft 16 can be given to the valve mechanism 96. Therefore, large centrifugal force can be imparted to the both expanded portions 96*d* of the valve mechanism 96 and the small-sized valve mechanism 96 can open and close the both through-holes 34*b* according to the rotating speed of the drive shaft 16.

Also, with the compressor, since the valve mechanism 96 is of a lead type, the valve mechanism 96 is hard to malfunction due to taking a bite on foreign matters and so operates stably. The remaining function and effect are the same as those of EMBODIMENT 1.

Embodiment 5

Figure 2:
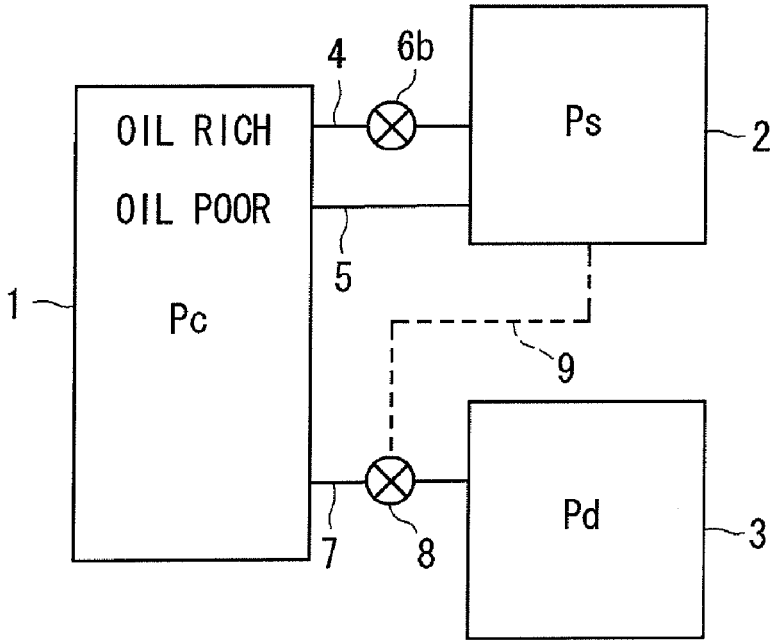
FIG. 2 is a schematic view showing a further embodiment of the invention.
Figure 19:
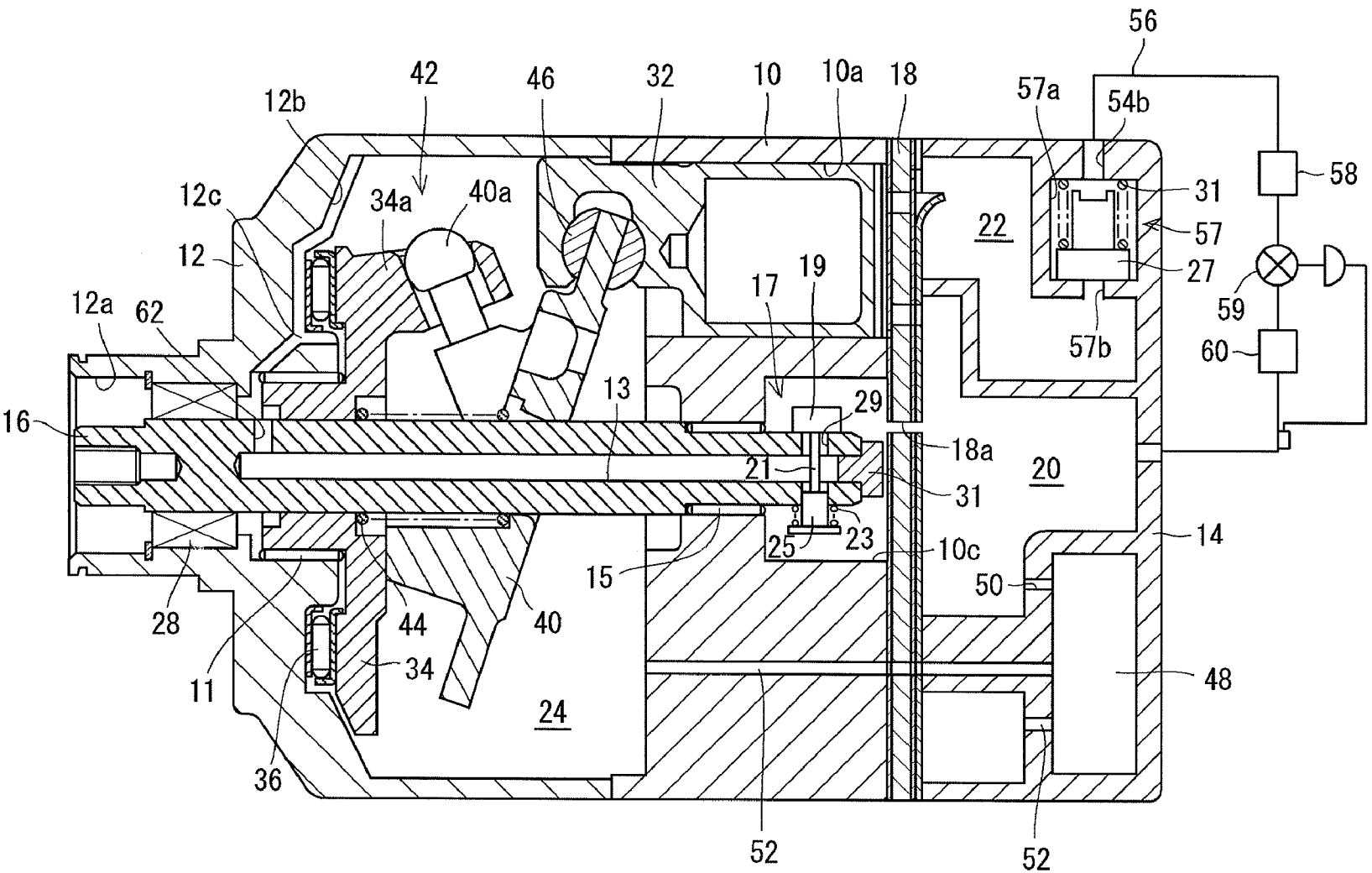
FIG. 19 is a cross sectional view showing a swash plate compressor according to EMBODIMENT 5.

A swash plate compressor according to EMBODIMENT 5 is obtained by embodying an embodiment of FIG. 2. With the compressor, a first hole 62 and an outflow hole 13 are formed on a drive shaft 16 as shown in FIG. 19. The outflow hole 13 is provided through the drive shaft 16 to extend to a rear end thereof and to be coaxial with an axis of the drive shaft 16. Also, a valve hole 29 is provided rearwardly of and radially of the drive shaft 16 to be communicated to the outflow hole 13. A spacer 31 is fixed to a rear end of the drive shaft 16 to close the outflow hole 13.

Figure 20:
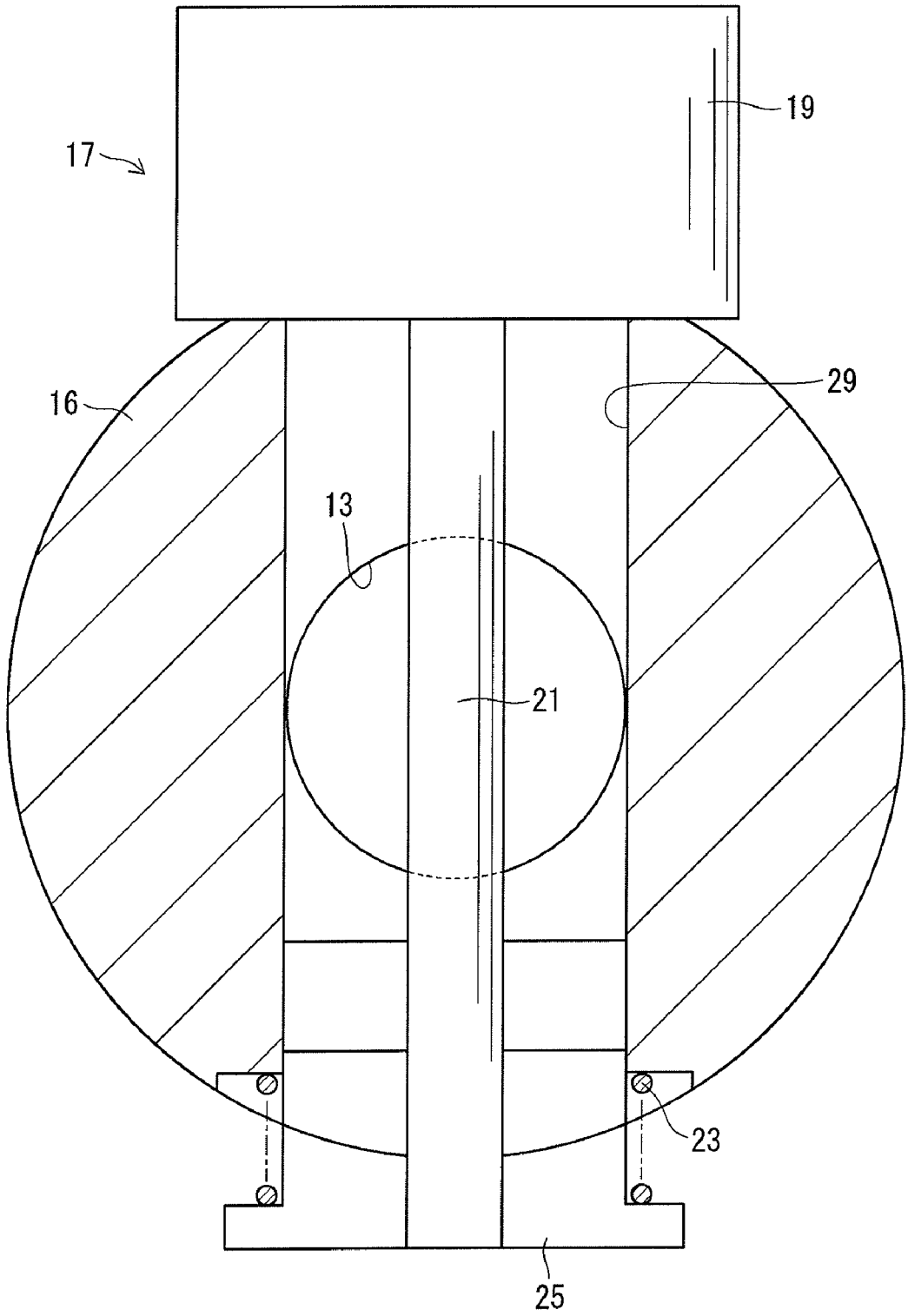
FIG. 20 relates to the swash plate compressor according to EMBODIMENT 5 and is a cross sectional view showing, in enlarged scale, an essential part thereof while a drive shaft is rotated at low speed.
Figure 21:
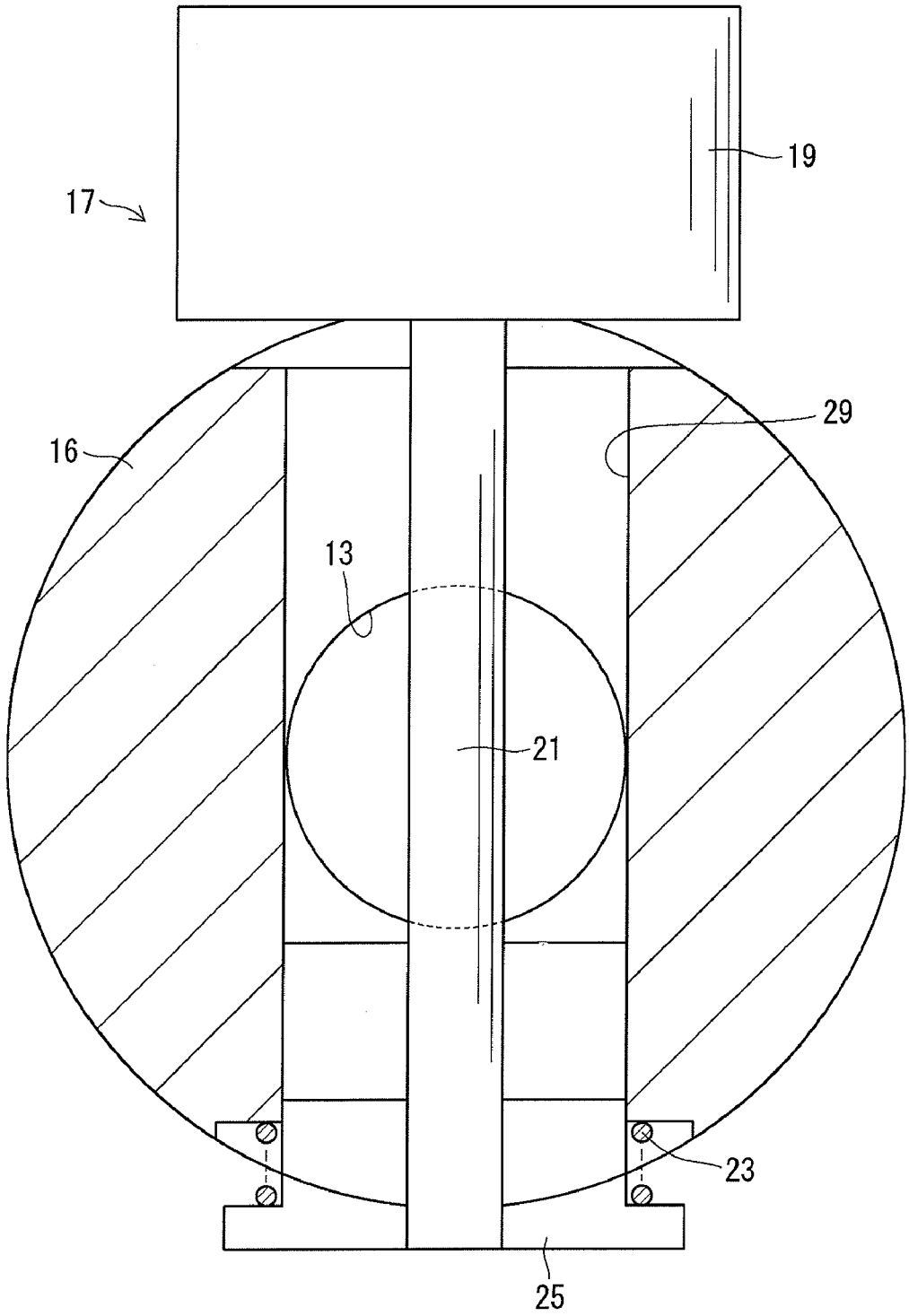
FIG. 21 relates to the swash plate compressor according to EMBODIMENT 5 and is a cross sectional view showing, in enlarged scale, an essential part thereof while the drive shaft is rotated at high speed.

As shown in FIGS. 20 and 21, an valve mechanism 17 is provided on the valve hole 29. A valve seat 25 is provided slidably in the valve hole 29, the valve seat 25 being connected to a valve body 19 by a connecting bar 21 extending in the valve hole 29. A spring 23 is provided between a flange of the valve seat 25 and an outer surface of the drive shaft 16 to provide for the bias in a direction, in which the valve body 19 is separated from the outer surface of the drive shaft 16. The valve body 19 serves also as a mass body. The valve body 19 is seated on the outer surface of the drive shaft 16 by the spring 23.

Also, as shown in FIG. 19, in place of the plain bearings 38, 30 in EMBODIMENT 1 to EMBODIMENT 4, radial bearings 11, using rollers are provided between a front housing 12 and a lug plate 34 and between a cylinder block 10 and the drive shaft 16. An oil guide groove 12*b*, an oil guide hole 12*c*, a first hole 62, an outflow hole 13, the axial hole 29, a radial bearing 15, and a throttle hole 18*a* constitute a release passage. The oil guide groove 12*b*, the oil guide hole 12*c*, the first hole 62, the outflow hole 13, the axial hole 29, and the throttle hole 18*a* constitute a first passage. Also, the radial bearing 15 and the throttle hole 18*a* constitute a second passage.

Also, a valve chamber 57*a* communicated to a discharge chamber 22 is formed on a rear housing 14 and a check valve 57 is provided in the valve chamber 57*a*. The check valve 57 comprises a valve body 27 that can be seated on a through-hole 57*b* providing communication between the discharge chamber 22 and the valve chamber 57*a*, and a spring 31 that biases the valve body 27 toward the through-hole 57*b*. In addition, depiction of an oil separator is omitted. The remainder of the construction is the same as that of EMBODIMENT 1.

With the compressor, when the drive shaft 16 is rotated at high speed while a vehicle is running at high speed, or the like, the valve body 19 of the valve mechanism 17 is caused by large centrifugal force to get away from the axis of the drive shaft 16 against the bias of the spring 23, whereby the valve body 19 increases opening degree of the valve hole 29 as shown in FIG. 21. Therefore, the single valve mechanism 17 increases a ratio, at which the first hole 62 occupies the release passage, and decreases a ratio, at which the second hole occupies the release passage.

Also, when the drive shaft 16 is rotated at low speed while a vehicle is running at low speed, or the like, the valve body 19 of the valve mechanism 17 undergoes the bias of the spring 23 to approach the axis of the drive shaft 16 against small centrifugal force, and thus the valve body 19 decreases opening degree of the valve hole 29 as shown in FIG. 20. When the drive shaft 16 is rotated at a further low speed, the valve body 19 is seated on the valve hole 29. Therefore, the single valve mechanism 17 decreases a ratio, at which the first hole 62 occupies the release passage, and increases a ratio, at which the second hole occupies the release passage.

Accordingly, the compressor can also realize demonstration of an excellent sliding characteristic when the drive shaft 16 is rotated at high speed, and demonstration of a high refrigerating capacity when the drive shaft 16 is rotated at low speed. The remaining function and effect are the same as those of EMBODIMENT 1.

While the invention has been described with respect to EMBODIMENT 1 to EMBODIMENT 5, it goes without saying that the invention is not limited to EMBODIMENT 1 to EMBODIMENT 5 but can be appropriately changed within a scope not departing from the gist thereof and applied.

Figure 22:
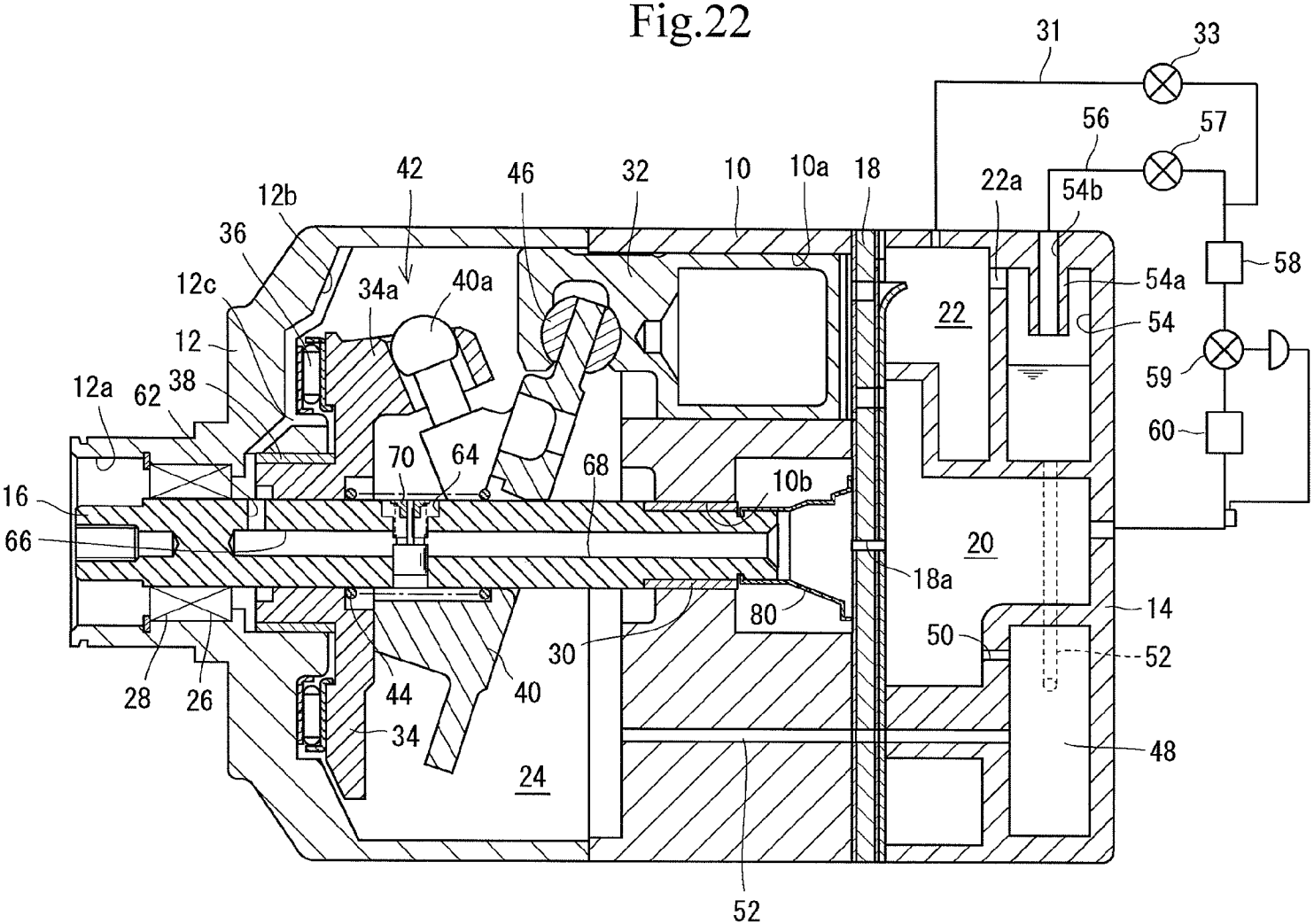
FIG. 22 is a cross sectional view showing a swash plate compressor according to a modification.

For example, with a so-called clutchless type compressor, in which a drive shaft 16 is rotated at all times through a pulley upon rotation of a drive source of a vehicle, a swash plate 40 provides for a minimum discharge capacity with an air-conditioning switch of a vehicle in OFF state and a check valve 57 is closed, so that refrigerating gas are circulated within the compressor. More specifically, the refrigerating gas are circulated through a crank chamber 24, a release passage, a discharge chamber 22, a storage chamber 54, a supply passage 52 to the crank chamber 24. In this case, as shown in FIG. 22, it is preferable to provide a bypass passage 31 that bypasses the check valve 57 to connect the discharge chamber 22 and a condenser 58, and a bypass valve 33 provided on the bypass passage.

With such construction, in the case where the compressor is rotated at high speed with the air-conditioning switch of a vehicle in OFF state and temperature in the discharge chamber 22 rises above a temperature as set, the bypass valve 33 is opened. Therefore, lubricating oil discharged into the discharge chamber 22 through a suction chamber 20 and a compression chamber from the crank chamber 24 is discharged to a refrigerating circuit outside the compressor not through the check valve 57. Therefore, it is possible to suppress an increase in temperature within the crank chamber 24 when the compressor is rotated at high speed. Also, in the case where a considerable space in the discharge chamber 22 cannot be ensured in terms of the construction of the compressor, the lubricating oil returned to the crank chamber 24 from the discharge chamber 22 can be reduced in quantity, so that the arrangement is preferred for suppression of temperature. In addition, it is possible to adopt various configurations such as a bimetal type, a wax type, an electromagnetic type one for the bypass valve 33.

Also, with a so-called clutchless type compressor, in which a drive shaft 16 is rotated at all times through a pulley upon rotation of a drive source of a vehicle, a check valve 57 is closed with an air-conditioning switch of a vehicle in OFF state, so that a refrigerating gas is circulated within the compressor. In this case, it is preferable to adopt an electromagnetic type capacity control valve, which comprises a solenoid in the capacity control valve 48, and in which a signal from outside energizes the solenoid to decrease opening degree of a supply passage 52, thereby enabling increasing a compressor in discharge capacity. Control can be exercised, in which a solenoid is energized to increase the compressor in discharge capacity to open the check valve 57 in the case where a temperature sensor is mounted inside or outside the compressor, such as a crank chamber 24 or the like and temperature detected by the temperature sensor exceeds a certain critical value.

When such control is exercised, when the compressor is rotated at high speed, lubricating oil discharged into the suction chamber 20 from the crank chamber 24 is discharged to a refrigerating circuit outside the compressor through the compression chamber, the discharge chamber 22, and the check valve 57. Also, since refrigerating gas from the refrigerating circuit outside the compressor are circulated, it is possible to further suppress temperature rise in the crank chamber 24 when the compressor is rotated at high speed with the air-conditioning switch of a vehicle in OFF state. Further, in the case where a considerable space in the discharge chamber 22 cannot be ensured in terms of the construction of the compressor, the lubricating oil returned to the crank chamber 24 from the discharge chamber 22 can be reduced in quantity, so that the arrangement is preferred for suppression of temperature in the crank chamber 24.

Figure 23:
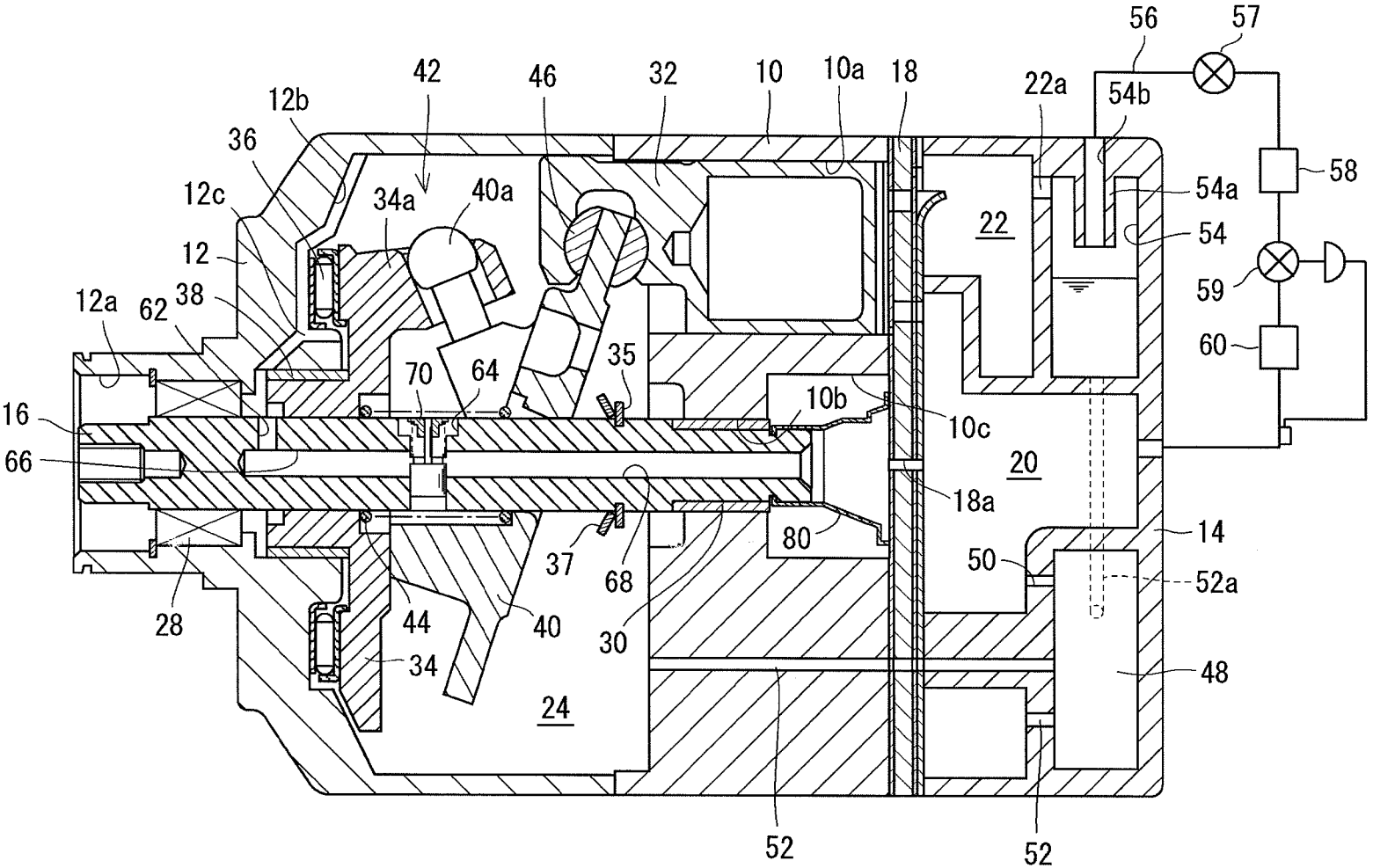
FIG. 23 is a cross sectional view showing a swash plate compressor according to a further modification.

Also, with a so-called clutchless type compressor, in which a drive shaft 16 is rotated at all times through a pulley upon rotation of a drive source of a vehicle, a check valve 57 is closed with an air-conditioning switch of a vehicle in OFF state, and a refrigerating gas is circulated within the compressor in the manner described above. In this case, a circlip 35 in the form of an annulus-shaped, flat plate fixed to a drive shaft 16 and a shim 37 interposed between a swash plate 40 and the circlip 35 are preferably arranged as a member that prescribes minimum inclination angle of the swash plate 40 as shown in FIG. 23. While the shim 37 is an annulus-shaped, flat plate like the circlip 35 in an ordinary operating state, it is formed from a shape memory alloy, in which an axial length of the drive shaft 16 is lengthened (for example, becomes funnel-shaped) in the case where temperature in the crank chamber 24 rises above a set temperature.

With such construction, in the case where the compressor is rotated at high speed with the air-conditioning switch of a vehicle in OFF state and temperature in the crank chamber 24 rises above a temperature as set, the shim 37 is deformed to bias the swash plate 40 being at the minimum inclination angle whereby the swash plate 40 is increased in inclination angle. Consequently, the compressor is increased in discharge capacity and the check valve 57 is opened. Therefore, when the compressor is rotated at high speed, lubricating oil discharged into the suction chamber 20 from the crank chamber 24 is discharged to a refrigerating circuit outside the compressor through the compression chamber, the discharge chamber 22, and the check valve 57. Also, since refrigerating gas from the refrigerating circuit outside the compressor are circulated, it is possible to further suppress temperature rise in the crank chamber 24 when the compressor is rotated at high speed in the case where the air-conditioning switch of a vehicle is put in OFF state. Further, in the case where a considerable space in the discharge chamber 22 cannot be ensured in terms of the construction of the compressor, the lubricating oil returned to the crank chamber 24 from the discharge chamber 22 can be reduced in quantity, so that the arrangement is preferred for suppression of temperature in the crank chamber 24. In addition, it is possible to adopt various configurations such as a bimetal type or the like for the shim 37.

Figure 3:
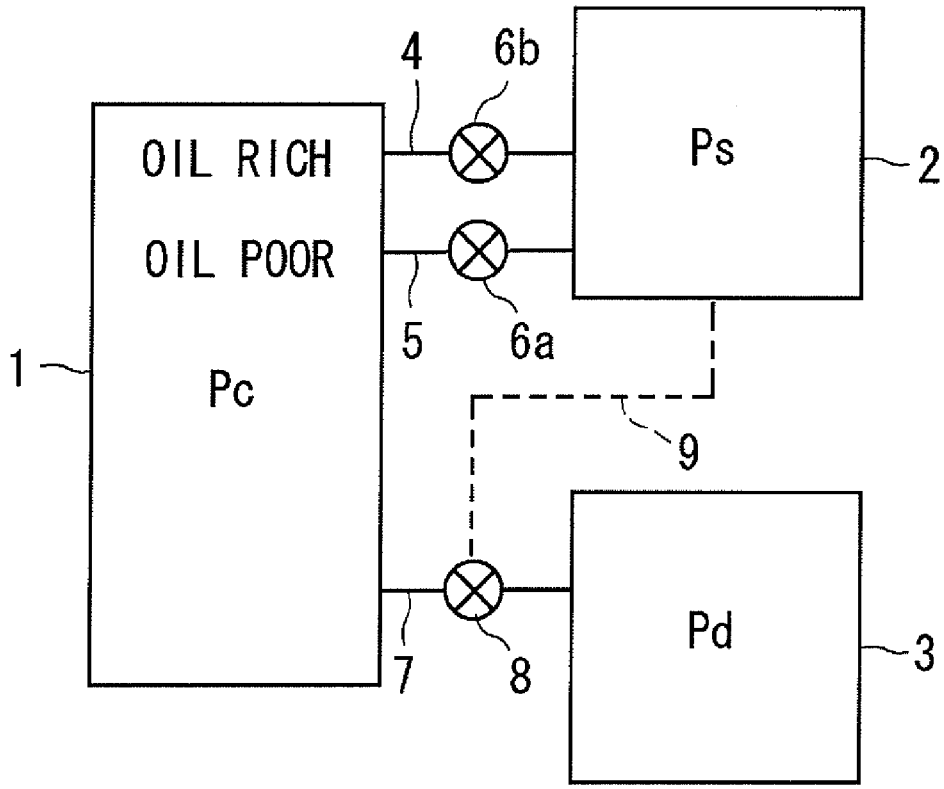
FIG. 3 is a schematic view showing a still further embodiment of the invention.

Also, a swash plate compressor according to the invention may comprise the embodiment of FIG. 3 as a further modification. Also, in the case where in the compressors according to EMBODIMENT 1 to EMBODIMENT 4, radial bearings using rollers are adopted in place of the plain bearings 38, 30, a release passage may be defined between the respective rollers and ratios, at which the first passage and the second passage occupy the release passage, may be changed. Also, the linkage 42 is not limited to one in the embodiment but various arrangements can be adopted. In place of the spacer 80 at the rear end of the drive shaft 16, a thrust bearing and a spring can be adopted.

In addition, with the swash plate compressor disclosed in JP-A-10-54350, a release passage comprises only a single passage formed on a drive shaft and composed of a first radial hole and an outflow hole, and the first radial hole is only communicated to a crank chamber on an outer periphery of the drive shaft. Therefore, with the swash plate compressor, lubricating oil in the crank chamber cannot be moved so much to a suction chamber through the release passage because the release passage only opens to an oil poor region near the drive shaft. Also, while JP-A-11-62824 discloses a swash plate compressor comprising the release passage, the same as disclosed in JP-A-10-54350, and a valve mechanism that opens and closes the release passage, the valve mechanism changes opening degree of the release passage according to the inclination angle of a swash plate, and thus, the function and effect of the invention cannot be achieved.

The swash plate compressor according to the invention may be of a fixed capacity type, in which a swash plate is not varied in inclination angle, or a variable capacity type, in which a swash plate is varied in inclination angle.

Also, with the swash plate compressor according to the invention, the release passage is enough to communicate the crank chamber to the suction chamber. The release passage may be one that communicates the crank chamber indirectly to the suction chamber through, for example, a suction passage communicated to the suction chamber, as well as one that communicates the crank chamber directly to the suction chamber. The release passage suffices to include the first passage, or may include a further passage.

The first passage is communicated to any one of those regions, in which lubricating oil is large in quantity. Regions, in which lubricating oil is present in abundance, are determined by intercomparison with other regions.

Further, the swash plate compressor according to the invention may adopt various valve mechanisms provided that they are displaced according to a rotating speed. For example, it is possible to detect a rotating speed with use of a rotation sensor, to detect centrifugal force with use of an acceleration sensor, and to adopt a valve mechanism using a solenoid that is displaced electromagnetically on the basis of a signal from the sensor. Also, it is possible to adopt a mechanical valve, in which a mass body is displaced by centrifugal force and a valve body is actuated.

With the swash plate compressor according to the invention, the valve mechanism is not limited to single but may be plural in number provided that an opening ratio of the first passage with respect to the release passage may be changed.

The release passage may include a second passage communicated to an oil poor region, in which lubricating oil contained in the refrigerating gas is small in quantity, in the crank chamber. The valve mechanism may increase an opening ratio of the first passage with respect to the whole release passage, as the drive shaft is increased in rotating speed, and may increase an opening ratio of the second passage with respect to the whole release passage, as the drive shaft is decreased in rotating speed.

In this case, when the drive shaft is rotated at high speed, the valve mechanism increases an opening ratio of the first passage with respect to the release passage, and decreases the opening ratio of the second passage with respect to the release passage. Also, when the drive shaft is rotated at low speed, the valve mechanism decreases an opening ratio of the first passage with respect to the whole release passage, and increases the opening ratio of the second passage with respect to the whole release passage. Thus, the function and effect of the invention may be surely produced.

In the case where the release passage includes both the first passage and the second passage, the valve mechanism is not limited to single but may be plural in number provided that an opening ratio of the first passage with respect to the whole release passage, and an opening ratio of the second passage with respect to the whole release passage may be changed. For example, as shown in FIG. 1, a crank chamber 1 and a suction chamber 2 are connected to each other by a first passage 4 and a second passage 5. The first passage 4 is connected to an oil rich region within the crank chamber 1, in which lubricating oil is large in quantity, and the second passage 5 is connected to an oil poor region within the crank chamber 1, in which the lubricating oil is small in quantity. It is possible to provide a valve mechanism 6*a* on the second passage 5. In addition, with a variable capacity type swash plate compressor, it is possible to connect the crank chamber 1 and a discharge chamber by a supply passage 7 and to provide a capacity control valve on the supply passage 7. The capacity control valve 8 can be connected by a suction pressure detection passage 9 connected to the suction chamber 2. Also, it is possible to provide a valve mechanism 6*b* on the first passage 4 as shown in FIG. 2. Further, it is possible to provide the valve mechanism 6*a* on the second passage 5 and to provide the valve mechanism 6*b* on the first passage 4 as shown in FIG. 3.

The valve mechanism may be provided on the second passage so as to be displaced by centrifugal force. FIG. 1 shows such a swash plate compressor provided with the valve mechanism on the second passage. The valve mechanism can be displaced in a direction, in which the second passage is decreased in opening degree, upon an increase in centrifugal force and may be displaced in a direction, in which the second passage is increased in opening degree, upon a decrease in centrifugal force.

The release passage may comprise a first hole formed on the drive shaft to extend in a radial direction and constituting a part of the first passage, a second hole formed on the drive shaft to extend in the radial direction and constituting a part of the second passage, a communication hole formed on the drive shaft to extend in an axial direction to provide communication between the first hole and the second hole and constituting a part of the first passage, and an outflow hole formed on the drive shaft to extend in the axial direction to communicate the communication hole to the suction chamber and constituting a part of the first passage and the second passage.

In this case, the single valve mechanism may change an opening ratio of the first passage with respect to the release passage, and an opening ratio of the second passage with respect to the release passage.

In the case where the second hole is provided to penetrate the drive shaft in the radial direction, the second hole and the outflow hole may be connected to each other to form an opening-degree regulating port at their connection. The second hole includes a first opening, which is communicated to the opening-degree regulating port to be opened on one end side thereof, and a second opening, which is communicated to the opening-degree regulating port to be opened on the other end side thereof. The valve mechanism may comprise a valve body that is positioned toward the first opening relative to an axis of the drive shaft and may be seated around the first opening, a mass body that is positioned toward the second opening relative to the axis of the drive shaft and may change an opening degree of the opening-degree regulating port, a connecting bar that connects the valve body and the mass body so as to make the valve body movable, and a spring that biases the valve body so as to fully open the first opening.

In this case, when the drive shaft is rotated at high speed, the mass body is caused by large centrifugal force to move away from the axis of the drive shaft against the bias of the spring, whereby the valve body decreases opening degree of the first opening. Therefore, the second hole reduces its opening degree for communication with the opening-degree regulating port, and the first hole increases its opening degree for communication with the opening-degree regulating port. Also, when the drive shaft is rotated at low speed, the mass body yields to the bias of the spring because of small centrifugal force, and approaches the axis of the drive shaft. Thus, the valve body increases opening degree of the first opening. Therefore, the second hole increases its opening degree for communication with the opening-degree regulating port, and the first hole reduces its opening degree for communication with the opening-degree regulating port. Thus the effect of the invention can be mechanically produced.

The second hole may include a valve seat, on which the valve body is seated, a first radial hole provided through the opening-degree regulating port to be communicated at the first opening to the crank chamber through the valve seat, and a second radial hole formed to have substantially the same diameter as that of the first radial hole, extending from the opening-degree regulating port to an opposite side to the first radial hole, and provided to extend to an outer periphery of the drive shaft to be communicated at the second opening to the crank chamber. The valve body is received in the first radial hole and the mass body is received in the second radial hole to enable changing opening degree of the opening-degree regulating port.

In this case, since the first radial hole and the second radial hole are substantially the same in diameter, crank chamber pressure acting on both the valve body received in the first radial hole and the mass body received in the second radial hole generates no pressure difference therebetween, and the valve body may operate stably. Such function and effect are especially effective in a variable capacity type swash plate compressor, in which a swash plate is supported to be variable in inclination angle and pressure in the crank chamber is increased to change the discharge capacity. Also, since the valve body is received in the first radial hole and the mass body is received in the second radial hole, both the valve body and the mass body being accommodated without protrusion from the outer periphery of the drive shaft, the valve mechanism does not obstruct the way in the crank chamber. Further, since the mass body changes opening degree of the opening-degree regulating port, there is no need of providing any separate valve body that changes opening degree of the opening-degree regulating port, and the valve mechanism may be made simple in construction. In addition, "substantially the same diameter" means that a different diameter in a range of an error or in a range, in which function and effect are produced, is allowable.

The valve mechanism is preferably set in characteristics so that the rotating speed of the drive shaft when the valve body moves toward the valve seat is higher than the rotating speed of the drive shaft when the valve body moves away from the valve seat.

In this case, since the valve body at a position where its opening degree is medium is hard to vibrate and the valve body is decreased in the number of operation, the valve body is hard to abrade and can demonstrate a high durability.

In the case where the second hole is formed on the drive shaft in the radial direction, the second hole can include an opening-degree regulating port communicated to the outflow hole and a first opening communicated to the opening-degree regulating port to be opened on one end side thereof. The valve mechanism can include a valve body received in the second hole, a first spring that biases the valve body toward the first opening, and a second spring that biases the valve body toward the opening-degree regulating port.

In this case, setting of the first and second springs makes it possible to heighten the rotating speed of the drive shaft when the valve body is seated on the valve seat. Since the valve body, opening degree of which is medium, is held by the first and second springs, it is hard to further vibrate and can demonstrate a high durability. Further, since the valve body can be completely received within the second hole, the valve mechanism does not obstruct the way in the crank chamber.

In case of setting the first and second springs to heighten the rotating speed of the drive shaft when the valve body is seated on the valve seat, a difference between pushing force f2 of the second spring and pushing force f1 of the first spring can be specifically set to be at least $m \cdot Rmin \cdot \omega^2$ and to be at most $m \cdot Rmax \cdot \omega^2$, where m indicates a mass of the valve body, Rmin indicates a minimum rotating speed of the drive shaft, Rmax indicates a maximum rotating speed of the drive shaft, and $\omega$ indicates a rotating speed of the drive shaft, at which the valve body closes the second hole.

Thereby, even when a distance from the axis to the mass body is small, the drive shaft can be made high in rotating speed when the valve body is seated on the valve seat.

With the swash plate compressor according to the invention, the swash plate can be supported to be variable in inclination angle. Also, a lug plate receiving compressive reaction force is fixed to and rotate integrally with the drive shaft. Further, the housing may be formed with an oil guide path, which extends between the housing and the lug plate from an outer peripheral region of the crank chamber. The first hole is preferably communicated to the oil guide path.

According to the experiments conducted by the inventors of the present invention, an outer peripheral region of the crank chamber is one, in which lubricating oil is large in quantity, so that the lubricating oil can be led to the first hole through the oil guide path.

A shaft seal device may be provided to seal between the housing and the drive shaft. The first hole is preferably communicated to the oil guide path through the shaft seal device.

In this case, a large quantity of the lubricating oil is supplied to the shaft seal device to enable heightening a rubber material of the shaft seal device in durability.

In the case where the second hole is provided on the drive shaft to extend therethrough in the radial direction, the second hole can include an opening-degree regulating port communicated to the outflow hole, a first opening communicated to the opening-degree regulating port to be opened on one end side thereof, and a second opening communicated to the opening-degree regulating port to be opened on the other end side thereof. Also, the lug plate can include a hinge portion that supports the swash plate to enable the same to fluctuate. The second opening is preferably positioned on an opposite side of an axis of the drive shaft to the hinge portion.

With such construction, motions of the valve body caused by centrifugal force are made high in accuracy and introduction of refrigerating gas from the first opening is not obstructed wherever a weight applied by the lug plate is positioned.

The second hole can be formed on the drive shaft in the radial direction to comprise a first introduction hole provided with the valve mechanism and a second introduction hole formed on the drive shaft in the radial direction and provided not with the valve mechanism. The second introduction hole is preferably opened and closed as the swash plate is varied in inclination angle.

In this case, while the function and effect of the invention can be produced according to the rotating speed of the drive shaft, the function and effect can be produced by the inclination angle of the swash plate.

The drive shaft is preferably provided with a sleeve that moves in an axial direction of the drive shaft as the swash plate is varied in inclination angle, thus enabling changing opening degree of the second introduction hole.

Since the swash plate is varied in inclination angle, the swash plate itself is hard to open and close the second introduction hole but this is readily realized by the sleeve.

The second introduction hole is preferably decreased in opening degree when the inclination angle of the swash plate to an imaginary plane perpendicular to the drive shaft is small.

In this case, when the drive shaft is rotated at high speed and the discharge capacity is small and variable, the first introduction hole is small in opening degree and the second introduction hole is small in opening degree. Therefore, in a state, in which the shaft seal device is under a severe condition, that ratio, at which the first hole occupies the release passage, become large, so that a large quantity of the lubricating oil is readily supplied to the shaft seal device.

A lug plate receiving compressive reaction force can be fixed to the drive shaft to be able to rotate integrally. Also, a through-hole can be formed on an inner peripheral side of the lug plate to form a part of the second passage. The lug plate can be provided with a valve mechanism that decreases opening degree of the through-hole as the drive shaft is increased in rotating speed, and increases opening degree of the through-hole as the drive shaft is decreased in rotating speed.

In this case, a mechanical valve mechanism can be provided on the lug plate, which is large in a radial direction, and a large distance from the axis of the drive shaft can be given to the valve mechanism. Therefore, large centrifugal force can be imparted to the valve mechanism and a small-sized valve mechanism can open and close the second hole according to the rotating speed of the drive shaft.

The valve mechanism can be of a lead type, which is caused by elastic force of itself to approach the axis of the drive shaft and caused by centrifugal force against the elastic force to separate from the axis of the drive shaft.

In this case, the valve mechanism is hard to malfunction due to taking a bite on foreign matters and so can operate stably.

The valve mechanism can be provided on the first hole so as to be displaced by centrifugal force. In this case, a swash plate compressor according to the embodiment of FIG. 2 is provided. The valve mechanism can be displaced in a direction, in which the first passage is increased in opening degree, upon an increase in centrifugal force and can be displaced in a direction, in which the first passage is decreased in opening degree, upon a decrease in centrifugal force.

The swash plate compressor according to the invention can comprise an oil separator provided in the storage chamber. The oil separator can include a storage chamber that separates lubricating oil from refrigerating gas in the discharge chamber to store the same, and an oil return passage for communication between the storage chamber and the crank chamber.

In this case, lubricating oil separated from refrigerating gas can be returned to the crank chamber. Therefore, in the case where a swash plate compressor is of a variable capacity type, the crank chamber is high in pressure and the suction chamber is low in pressure when the capacity is varied, so that the lubricating oil is readily ensured in the crank chamber even when the lubricating oil in the crank chamber flows to the suction chamber.

A throttle is preferably formed on the oil return passage.

In this case, lubricating oil is readily ensured in the crank chamber even when the crank chamber is low in pressure.

The swash plate compressor according to the invention can comprise a supply passage that communicates the discharge chamber to the crank chamber, and a capacity control valve provided on the supply passage to enable regulating pressure in the crank chamber. Preferably, the oil return passage defines a part of the supply passage and the throttle is provided in the capacity control valve.

In this case, a supply passage of an existing capacity control valve serves as an oil return passage, so that modification is readily made.

EXPLANATION OF INDUSTRIAL APPLICATION OF INVENTION

The invention can be made use of in air-conditioning apparatuses for vehicles.

The invention claimed is:

1. A swash plate compressor comprising:

a housing including a cylinder bore, a suction chamber, a discharge chamber and a crank chamber, a drive shaft having an axis and supported by the housing to rotate in the crank chamber, a swash plate supported on the drive shaft in the crank chamber, a piston accommodated in the cylinder bore to reciprocate, a motion conversion mechanism provided between the swash plate and the piston to convert wobbling of the swash plate into reciprocation of the piston, and a release passage for communication between the crank chamber and the suction chamber, the compressor being characterized in that the release passage is communicated to an oil rich region, in which lubricating oil is large in quantity, in the crank chamber, a valve mechanism is provided to increase an opening ratio of the release passage, as the rotational speed of the drive shaft increases, the valve mechanism includes a mass body and a spring, the mass body is positioned so as to separate from the axis of the drive shaft due to centrifugal force which acts on the mass body when the drive shaft rotates and to increase the opening ratio of the release passage due to the separation of the mass body from the axis, and the spring is positioned such that the bias of the spring resists the centrifugal force.

2. The swash plate compressor according to claim 1, wherein the release passage includes a first passage communicated to the oil rich region and a second passage communicated to an oil poor region, in which lubricating oil is small in quantity, in the crank chamber, and the valve mechanism increases an opening ratio of the first passage with respect to the release passage, as the rotational speed of the drive shaft increases, and an opening ratio of the second passage with respect to the release passage, as the rotational speed of the drive shaft decreases.

3. The swash plate compressor according to claim 2, wherein the valve mechanism is provided on the second passage, the valve mechanism operates based on the centrifugal force.

4. The swash plate compressor according to claim 3, wherein the release passage comprises:

a first hole formed on the drive shaft to extend in a radial direction and constituting a part of the first passage, a second hole formed on the drive shaft to extend in the radial direction and constituting a part of the second passage, a communication hole formed on the drive shaft to extend in an axial direction to provide communication between the first hole and the second hole and constituting a part of the first passage, and an outflow hole formed on the drive shaft to extend in the axial direction to communicate the communication hole to the suction chamber and constituting a part of the first passage and the second passage.

5. The swash plate compressor according to claim 4, wherein the second hole radially penetrates the drive shaft, the second hole includes an opening-degree regulating port communicated to the outflow hole, a first opening communicated to the opening-degree regulating port to be opened on one end side thereof, and a second opening communicated to the opening-degree regulating port to be opened on the other end side thereof, the valve mechanism further comprises a valve body that is positioned toward the first opening relative to the axis of the drive shaft and opens and closes the first opening and a connecting bar that connects the valve body and the mass body so as to make the valve body movable with the mass body, the mass body is positioned toward the second opening relative to the axis of the drive shaft and capable of changing the opening degree of the first opening, and the spring biases the valve body in a direction that the first opening opens.

6. The swash plate compressor according to claim 5, wherein the second hole includes a valve seat, on which the valve body is seated, a first radial hole extending from the opening-degree regulating port, the first radial hole being communicated at the first opening to the crank chamber through the valve seat, and a second radial hole formed to have substantially the same diameter as that of the first radial hole, the second radial hole extending from the opening-degree regulating port in a direction opposite to the first radial hole to an outer periphery of the drive shaft for communication at the second opening with the crank chamber, and wherein the valve body is received in the first radial hole and the mass body is received in the second radial hole to enable to change in an opening degree of the opening-degree regulating port.

7. The swash plate compressor according to claim 6, wherein the mass of the mass body and the spring constant of the spring are set so that the rotating speed of the drive shaft when the valve body moves toward the valve seat is higher than the rotating speed of the drive shaft when the valve body moves away from the valve seat.

8. The swash plate compressor according to claim 4, wherein the second hole includes an opening-degree regulating port communicated to the outflow hole and a first opening communicated to an opening-degree regulating port to be opened on one end side thereof, and the valve mechanism includes a valve body received in the second hole, a first spring that biases the valve body toward a first opening, and a second spring that biases the valve body toward the opening-degree regulating port.

9. The swash plate compressor according to claim 8, wherein a difference between biasing force f2 of the second spring and biasing force f1 of the first spring is set to be at least $m \cdot Rmin \cdot \omega^2$ and to be at most $m \cdot Rmax \cdot \omega^2$.

wherein m indicates a mass of the valve body, Rmin indicates a minimum rotating speed of the drive shaft, Rmax indicates a maximum rotating speed of the drive shaft, and $\omega$ indicates a rotating speed of the drive shaft, at which the valve body closes the second hole.

10. The swash plate compressor according to claim 4, wherein the swash plate is supported to be variable in inclination angle, a lug plate receiving compressive reaction force is fixed to the drive shaft to be able to rotate integrally, the housing is formed with an oil guide path, which extends between the housing and the lug plate from an outer peripheral region of the crank chamber, and the first hole is communicated to the oil guide path.

11. The swash plate compressor according to claim 10, wherein a shaft seal device is provided to seal between the housing and the drive shaft, and the first hole is communicated to the oil guide path at a position where the shaft seal device is provided.

12. The swash plate compressor according to claim 10, wherein the second hole includes an opening-degree regulating port communicated to the outflow hole, a first opening communicated to the opening-degree regulating port to be opened on one end side thereof, and a second opening communicated to the opening-degree regulating port to be opened on the other end side thereof, the lug plate includes a hinge portion that tiltably supports the swash plate, and the second opening is positioned on a side opposite to the hinge portion with respect to the axis of the drive shaft.

13. The swash plate compressor according to claim 10, wherein the second hole comprises a first introduction hole provided with the valve mechanism and a second introduction hole provided with an additional valve mechanism, and wherein the valve mechanism opens and closes the first introduction hole based on the rotational speed of the drive shaft, and the additional valve mechanism opens and closes the second introduction hole based on the inclination angle of the swash plate.

14. The swash plate compressor according to claim 13, wherein the drive shaft is provided with a sleeve that moves in an axial direction of the drive shaft as the swash plate is varied in inclination angle, and the second introduction hole is located in a range that the sleeve moves, whereby opening degree of the second introduction hole is changed in accordance with movement of the sleeve.

15. The swash plate compressor according to claim 13, wherein the second introduction hole is decreased in opening degree when the inclination angle of the swash plate with respect to an imaginary plane perpendicular to the drive shaft is small.

16. The swash plate compressor according to claim 3, wherein a lug plate receiving compressive reaction force is fixed to and rotates integrally with the drive shaft, a through-hole is formed on an inner peripheral side of the lug plate to form a part of the second passage, and the lug plate is provided with a valve mechanism that decreases opening degree of the through-hole as the drive shaft is increased in rotating speed, and increases opening degree of the through-hole as the drive shaft is decreased in rotating speed.

17. The swash plate compressor according to claim 16, wherein the valve mechanism includes a reed type valve body, which is caused by elastic force of itself to approach the axis of the drive shaft and caused by centrifugal force against the elastic force to move away from the axis of the drive shaft.

18. The swash plate compressor according to claim 1, further comprising an oil separator, a storage chamber that accommodates the oil separator and separates lubricating oil from refrigerating gas in the discharge chamber to store the separated oil, and an oil return passage connecting the storage chamber to the crank chamber for returning the oil to the crank chamber.

19. The swash plate compressor according to claim 18, wherein a throttle is formed on the oil return passage.

20. The swash plate compressor according to claim 19, further comprising a supply passage that communicates the discharge chamber to the crank chamber, and a capacity control valve provided on the supply passage to enable regulating pressure in the crank chamber, and wherein the oil return passage defines a part of the supply passage and the throttle is provided in the capacity control valve.

* * * * *